US006134924A

United States Patent [19]

Enderlin et al.

[11] Patent Number: 6,134,924

[45] **Date of Patent: *Oct. 24, 2000**

[54] APPARATUS FOR CARRYING OUT A PROCESS FOR THE CONTINUOUS DYEING OF YARNS WITH REACTIVE DYES

[75] Inventors: Robert Enderlin, Morschwiller-le-Bas; Mickael Mheidle, Sausheim; Didier Thibault, Bru, all of France

[73] Assignees: Ciba-Geigy Corporation, Mulhouse, France; Superba, Tarrytown, N.Y.

[ * ] Notice: This patent is subject to a terminal disclaimer.

[21] Appl. No.: 09/345,369

[22] Filed: Jul. 1, 1999

Related U.S. Application Data

[62] Division of application No. 09/072,468, May 4, 1998, Pat. No. 5,983,678, which is a division of application No. 08/728,869, Oct. 10, 1996, Pat. No. 5,891,201.

[30] Foreign Application Priority Data

Oct. 13, 1995 [FR] France ..... 95 12193

[51] Int. Cl.[7] ..... D06B 3/06

[52] U.S. Cl. ..... 68/10; 68/19.1; 68/20; 68/205 R

[58] Field of Search ..... 68/5 D, 9, 10, 68/19.1, 20, 205 R, 151.2

[56] References Cited

U.S. PATENT DOCUMENTS

| | | | |
|---|---|---|---|
| 2,432,404 | 12/1947 | Galatioto | 8/151.2 |
| 3,456,431 | 7/1969 | Fleissner | 8/151.2 X |
| 5,491,858 | 2/1996 | Massotte et al. | 68/205 R X |
| 5,557,953 | 9/1996 | Massotte et al. | 68/205 R |

*Primary Examiner*—Philip R. Coe
*Attorney, Agent, or Firm*—Young & Thompson

[57] ABSTRACT

The present invention relates to a process for the continuous dyeing of cellulose fibre yarns with reactive dyes and to an apparatus for carrying out this process.

The process essentially comprises steps of impregnating yarn which has been continuously unwound at high speed from one or several supports (1) and rewound onto one or several supports (3) with at least one fibre-reactive dye in aqueous solution and at least one alkaline reagent in aqueous solution, and fixing the dye.

The invention can be applied especially in the technical field of dyeing cellulose fibres.

18 Claims, 10 Drawing Sheets

Fig-3
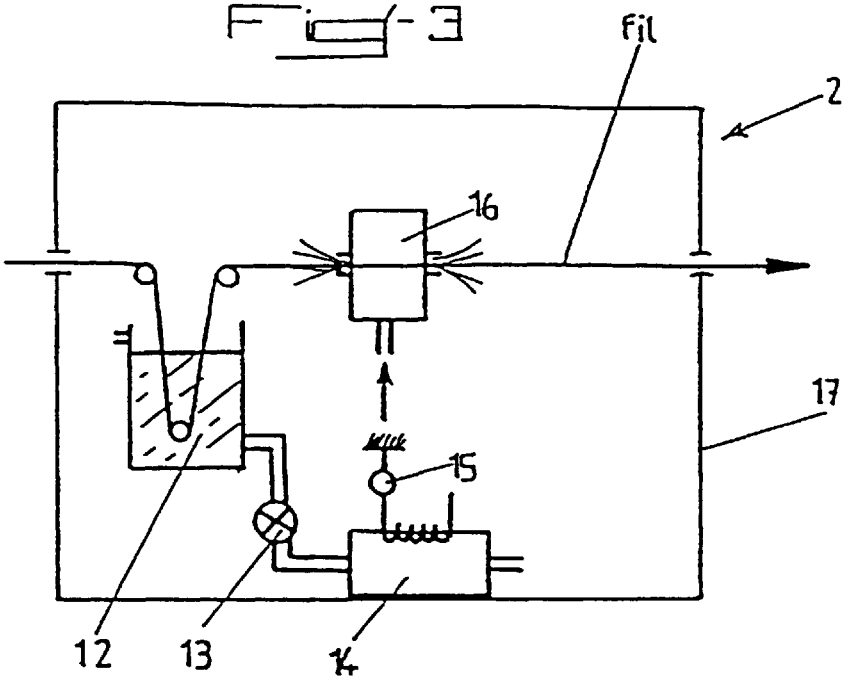
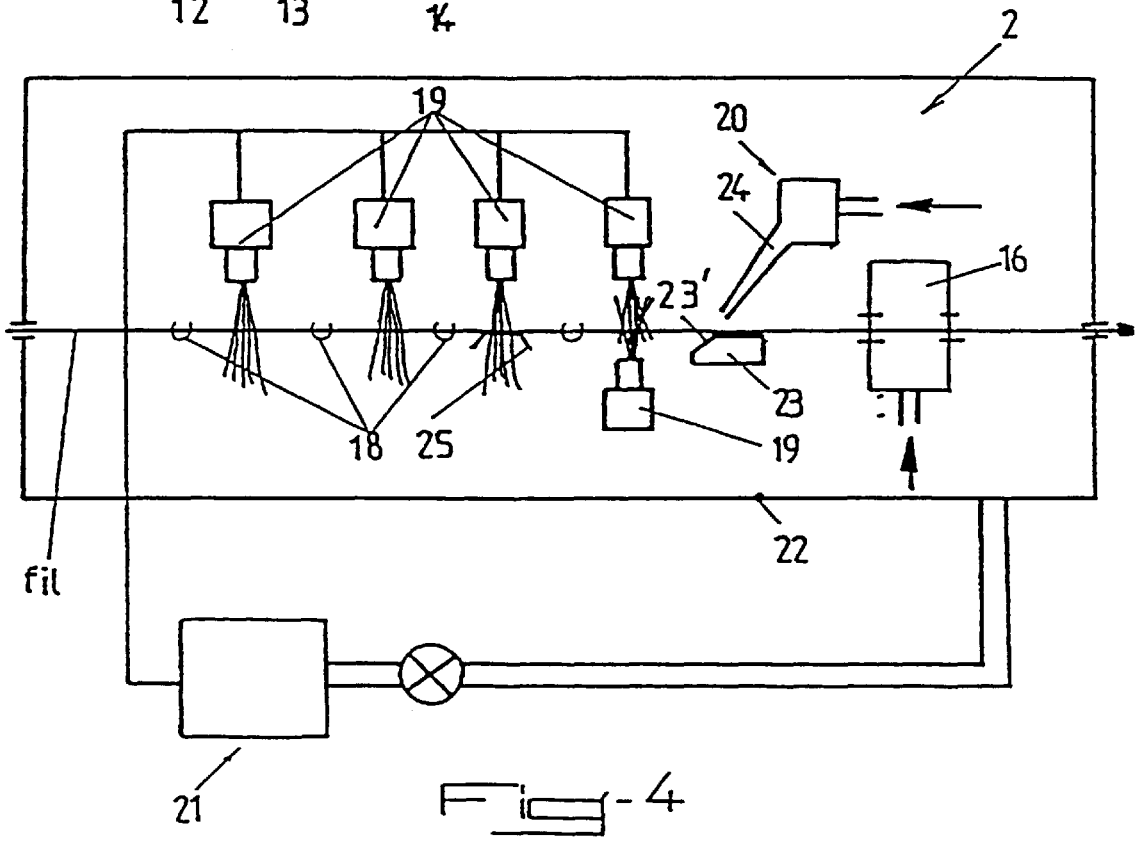
Fig-4

2
2'

APPARATUS FOR CARRYING OUT A PROCESS FOR THE CONTINUOUS DYEING OF YARNS WITH REACTIVE DYES

This application is a division of application Ser. No. 09/072,468 filed on May 4, 1998, now U.S. Pat. No. 5,983,678; which is a division of application Ser. No. 08/728,869 filed on Oct. 10, 1996, now U.S. Pat. No. 5,891,201.

FIELD OF THE INVENTION

The present invention is in the technical field of textiles, in particular of dyeing and very particularly of dyeing textile yarns, and relates to a process for the continuous dyeing of cellulose fibre yarns with reactive dyes.

The invention also provides an apparatus for carrying out this process.

BACKGROUND OF THE INVENTION

Various processes and apparatuses for the dyeing of yarns are already known.

Thus, for example, a hank-dyeing process is known in which yarn delivered from the spinning mill on a bobbin and rewound onto a conical bobbin is unwound on a hank-reeling machine, in order to obtain yarn in the form of hanks, with further handling taking place with transport of the bobbins. Each hank is then attached manually at different points, and the two ends of each hank are tied up with one another. The resulting hanks are then placed on dyeing beams, attached to a carriage and transferred to a dyeing apparatus. After dyeing, the hanks are washed, their excess water is removed in a hydroextractor, and the hanks are then dried either in a hot air through-circulation oven or by passing them continuously through a drying tunnel. After this drying, the hanks are placed again on a winding device to be rewound onto conical bobbins usable in knitting or weaving.

Such a dyeing process, which gives acceptable results as regards the inter-fibre penetration of the dyeing liquor, necessitates many handling operations, resulting in relatively long process times which are stressful to the material and in high production costs.

Package-dyeing processes are also known, in which yarn delivered from the spinning mill on a bobbin is rewound onto a conical or a cylindrical bobbin, the borders of the bobbin being optionally rounded by pressing, in order to allow better subsequent circulation of a dyeing liquor into the inside of the bobbin.

According to this embodiment, another handling operation consists in stacking bobbins on perforated columns of the material support of a dyeing apparatus, after which this material support is placed in an autoclave and a dyeing liquor is injected under pressure into the autoclave by means of a pump. After a predetermined period, the dyeing liquor is removed, and washwater is injected into the autoclave. The material support is then removed from the autoclave, and the bobbins are placed in a hydroextractor to remove excess water.

After this operation, the bobbins are dried batchwise in a drying cabinet or continuously in a high-frequency oven. After drying, the yarn is rewound.

The excess water can also be removed by means of apparatuses referred to as high-speed dryers, in which the unit comprising material support and bobbins is drained by means of a vacuum pump and is then pressurized in an autoclave by means of air or steam. In such a case, additional drying is no longer necessary.

Like the previous process, such a package-dyeing process requires many operator interventions and extends over a relatively long period, as a result of which the costs of this process are relatively high.

On the other hand, these traditional package- or hank-dyeing processes are not capable of producing special yarns, such as chiné yarns, "space" yarns, single- or multicolour speckled yarns, or yarns with partial impregnation of the fibres, for example of the washed-out type, of the ring-dyed denim type or of the stone washed denim type.

Moreover, when dyeing cellulose fibres, plant fibres, such as cotton, linen etc., or chemical fibres, such as the acetate and viscose fibres, the known dyeing processes involve a high consumption of water, i.e. in the order of 200 to 300 liters per kilogram of dyed yarn.

Such a consumption of water has not only the disadvantage of the cost of the consumed water, but also that of the treatment of the water enriched with dyes and the residual chemical auxiliaries before it is discharged.

However, in the case of the dyes used for cellulose fibres, the customary reagents must also be taken into consideration which, when used for preparing the dyeing liquor, require a large amount of added salt, namely in the order of 80 to 100 g per liter of dyeing liquor, of which only 60 to 70% of the mixture are fixed during the dyeing process and the remaining 30 to 40% of the mixture are discharged during washing and represent a major pollution source, requiring a particularly thorough treatment of the wastewater.

Furthermore, when dyeing in the form of packages and, to a lesser extent, in the form of hanks, the multiple unwinding and rewinding operations of the yarn have adverse effects on the quality of the yarn product, including, on the one hand, a loss of weight and, on the other, a loss of tenacity and elongation of the yarn.

Apparatuses are also known in which processes for the continuous dyeing of textile yarns are carried out by continuous impregnation of moving yarns, which are subsequently transferred to a conveying means, which takes the yarns through chambers containing steam or hot air under atmospheric or elevated pressure. Such a process, called thermofixing, enables the dyes to be fixed on the fibres constituting the yarn.

Such apparatuses make it possible in particular to dye yarns based on polyamide, polyester, polypropylene and acrylic fibres and also wool and fibre blends, with a substantially reduced consumption of energy and water compared with the treatment processes in the form of packages or hanks.

These continuous treatment processes only make use of acid dyes, disperse dyes or basic dyes.

SUMMARY OF THE INVENTION

The object of the present invention is to limit these disadvantages by providing a process and an apparatus for the continuous dyeing of yarns based on cellulose fibres, by means of which a substantial saving of dyes with optimum fixation and fancy effects, such as chiné yarns, "space" yarns, single- or multicolour speckled yarns, or yarns with partial impregnation of the fibres, for example of the washed-out type, of the ring-dyed denim type or of the stone washed denim type, can be obtained.

Accordingly, the present invention provides a process for the continuous dyeing of yarns based on cellulose fibres, which comprises the steps of a) impregnating yarn which has been continuously unwound at high speed from one or several supports and rewound onto one or several supports with at least one fibre-reactive dye in aqueous solution and, at least one alkaline reagent in aqueous solution, and b) fixing the dye.

According to a feature of the present invention, the yarn is first impregnated with at least one fibre-reactive dye in aqueous solution and then with at least one alkaline reagent in aqueous solution.

According to one embodiment of the present invention, the yarn is first impregnated with at least one alkaline reagent in aqueous solution and then with at least one fibre-reactive dye in aqueous solution.

According to another embodiment of the present invention, the yarn can also be impregnated with one or more dyes which are employed individually or in a mixture in the form of one or more dyeing liquors containing at least one fibre-reactive dye and at least one alkaline reagent.

According to another feature of the invention, fixing of the dye(s) is carried out by storing the support(s) comprising the yarn impregnated with the dyeing liquor(s).

According to another embodiment of the invention, fixing of the dye(s) can also be carried out directly after impregnation by treating the yarn with a hot gas, in particular with air, or by treating it with saturated or superheated steam.

The invention also provides an apparatus for implementing this process, which essentially comprises an apparatus for the continuous high-speed unwinding of yarn (fil) from one or several supports, an apparatus for impregnating the unwound yarn(s) with one or several dyes which are employed individually or in a mixture in the form of one or more dyeing liquors, a device for rewinding the treated yarn(s) onto one or several other supports, and an agent for fixing the dyes.

BRIEF DESCRIPTION OF THE DRAWINGS

The invention will be better understood by virtue of the description given below, which refers to a preferred implementation, which is given merely by way of non-limiting example and is explained with reference to the accompanying schematic drawings, in which:

FIGS. 3 to 9 and 12 are sectional views of different embodiments of the impregnation apparatus.

DETAILED DESCRIPTION OF THE INVENTION

Figure 1:
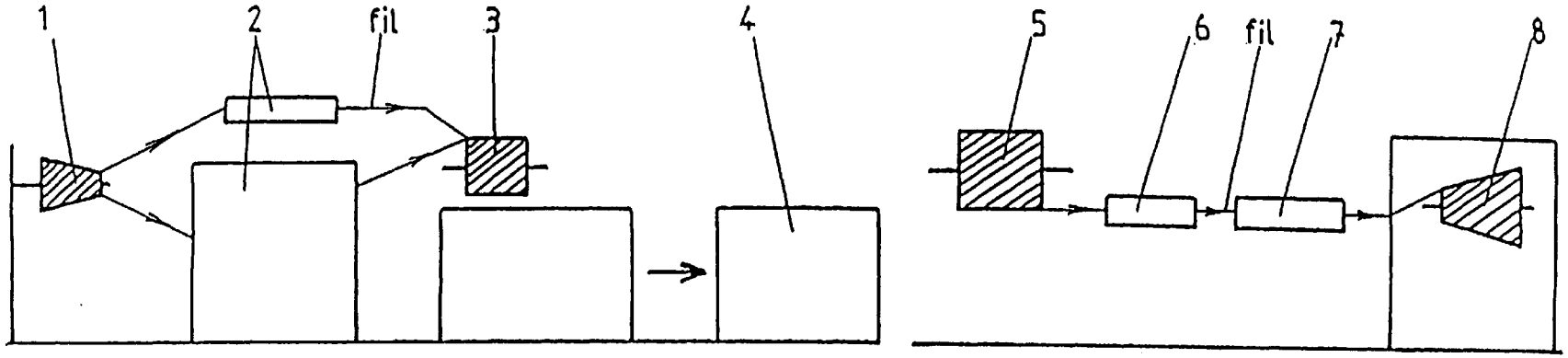
FIG. 1 is a side elevation view of an apparatus for implementing the process according to the invention.

According to the invention, and as shown especially in FIG. 1 of the accompanying drawings, the process for the continuous dyeing of yarns based on cellulose fibres preferably comprises the steps of impregnating the yarn in an impregnation apparatus 2 with at least one fibre-reactive dye in aqueous solution and at least one alkaline reagent in aqueous solution, the yarn being unwound continuously at high speed from one or several supports 1 and rewound onto one or several other supports 3, and fixing the dye.

The process is implemented by means of an apparatus which essentially comprises a device for unwinding the yarns continuously at high speed comprising one or more supports 1, an apparatus 2 for impregnating the unwound yarn(s) with one or more dyes, a device for rewinding the treated yarn(s) comprising one or several other supports 3, and an agent 4 for fixing the dyes.

The unwinding, rewinding and treatment rates of the yarn(s) are preferably at least 100 m/min, in particular at least 250 m/min and most preferably at least 300 m/min. The upper limits are for example 1000 m/min and in particular 600 m/min.

The unwinding, rewinding and treatment rates of the yarns(s) are preferably between 100 m/min and 1000 m/min, preferably between 250 m/min and 600 m/min.

The yarn unwinding unit comprising one or several supports 1 is not shown in detail in the accompanying drawings, and can consist in a known manner of a rack comprising spindles which support the yarn bobbins or supercops. It is also possible to unwind the yarns from a support such as a warp beam. Likewise, the rewinding device can be composed of a winding machine comprising multiple spindles or of a single support such as a yarn roller. Thus, for example, the yarn can be unwound and rewound from bobbin to bobbin, from one or more bobbins onto a yarn roller, from one yarn roller onto another yarn roller, or from one yarn roller onto one or more bobbins.

The dyes used in the dyeing liquors are reactive dyes which are suitable for dyeing cellulose materials, such as the dyes from the group consisting of mono-, dis- or polyazo dyes, metal complex azo dyes or anthraquinone, phthalocyanine, formazan or dioxazine dyes containing at least one reactive group. In addition, these dyes preferably contain at least one sulfo group.

Reactive groups are understood to mean radicals which are reactive with fibres and are capable of reacting with the hydroxyl groups of cellulose or with the amino, carboxyl, hydroxyl and mercapto groups of wool or silk or with the amino groups or, if present, the carboxyl groups of synthetic polyamides, with the formation of covalent chemical bonds. In general, the reactive groups are bonded to the dye radical directly or through a bridging element. Examples of suitable reactive groups are those containing at least one substituent which can be eliminated from an aliphatic, aromatic or heterocyclic radical or those in which these radicals contain a radical capable of reacting with the fibre material, such as a halotriazinyl, halopyrimidinyl or vinyl radical.

Examples of suitable aliphatic reactive groups are those of the following formulae:

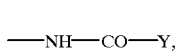

(1)

(1a)

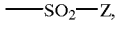

(1b)

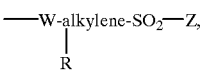

(1c)

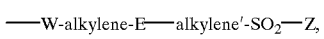

-continued (1d)

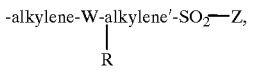

(1e)

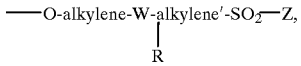

(1f)

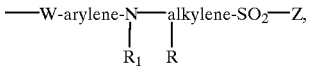

in which W is a group of the formula —$SO_2$—$NR_1$—, —$CONR_1$— or —$NR_1CO$—, $R_1$ is hydrogen, unsubstituted or hydroxyl-, sulfo-, sulfato-, carboxyl- or cyano-substituted $C_1$–$C_4$alkyl or a radical of the formula

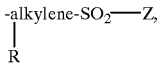

R is hydrogen, hydroxyl, sulfo, sulfato, carboxyl, cyano, halogen, $C_1$–$C_4$alkoxycarbonyl, $C_1$–$C_4$alkanoyloxy, carbamoyl or the group —$SO_2$—Z, Z is vinyl or a radical —$CH_2$—$CH_2U_1$ and $U_1$ is a leaving group, Y is a radical of the formula —CH(hal)—$CH_2$hal or —C(hal)=$CH_2$ and hal is halogen, E is the radical —O— or —N($R_2$)—, $R_2$ is hydrogen or $C_1$–$C_4$alkyl, alkylene and alkylene', independently of one another, are $C_1$–$C_6$alkylene, and arylene is an unsubstituted or a sulfo-, carboxyl-, $C_1$–$C_4$alkyl, $C_1$–$C_4$alkoxy- or halogen-substituted phenylene or naphthylene radical.

Preferred aliphatic reactive groups are those of the formulae (1) and (1a) to (1d), in particular those of the formulae (1), (1a) to (1c) and preferably those of the formulae (1), (1a) and (1b). Of particular interest are those of the formulae (1) and (1a), in particular those of the formula (1a).

Suitable heterocyclic reactive radicals are preferably 1,3,5-triazine radicals of the formula (2)

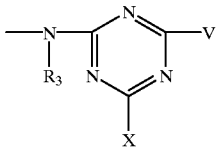

in which $R_3$ is hydrogen or unsubstituted or carboxyl-, cyano-, hydroxyl-, sulfo- or sulfato-substituted $C_1$–$C_4$alkyl, X is a group which can be eliminated as an anion, and V is a radical of the formula (3a)

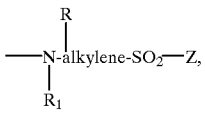

-continued (3b)

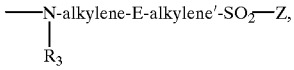

(3c)

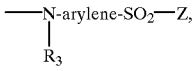

(3d)

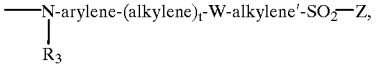

(3e)

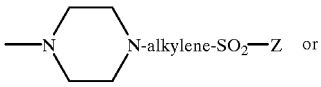

(3f)

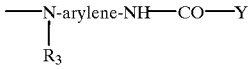

in which R, $R_1$, $R_3$, E, W, Z, Y, alkylene, alkylene' and arylene are as defined above, and t is 0 or 1.

Examples of the leaving group $U_1$ include —Cl, —Br, —F, —$OSO_3H$, —$SSO_3H$, —OCO—$CH_3$, —$OPO_3H_2$, —OCO—$C_6H_5$, —$OSO_2$—$C_1$–$C_4$alkyl or —$OSO_2$—N($C_1$–$C_4$alkyl)$_2$. Preferably, $U_1$ is a group of the formula —Cl, —$OSO_3H$, —$SSO_3H$, —OCO—$CH_3$, —OCO—$C_6H_5$ or —$OPO_3H_2$, in particular —Cl or —$OSO_3H$ and particularly preferably —$OSO_3H$.

Alkylene and alkylene', independently of one another, are, for example, a methylene, ethylene, 1,3-propylene, 1,4-butylene, 1,5-pentylene or 1,6-hexylene radical or branched isomers thereof.

Preferably, alkylene and alkylene' are a $C_1$–$C_4$alkylene radical and particularly preferably an ethylene radical.

R is preferably hydrogen or the group —$SO_2$—Z where Z has the abovementioned meanings and preferences. Particularly preferably, R is hydrogen.

$R_1$ is preferably hydrogen, $C_1$–$C_4$alkyl or a group -alkylene-$SO_2$—Z in which alkylene and Z are each as defined above. Particularly preferably, $R_1$ is hydrogen or $C_1$–$C_4$alkyl, in particular hydrogen.

$R_3$ is preferably hydrogen or a $C_1$–$C_4$alkyl radical and particularly preferably hydrogen.

Arylene is preferably a 1,3- or 1,4-phenylene radical which is unsubstituted or substituted, for example, by sulfo, methyl, methoxy or carboxyl.

E is preferably —NH— and particularly preferably —O—.

W is preferably a group of the formula —NHCO— or in particular —CONH—.

X is, for example, fluorine, chlorine, bromine, sulfo, $C_1$–$C_4$-alkylsulfonyl or phenylsulfonyl and preferably chlorine or in particular fluorine.

Hal is preferably chlorine or bromine, in particular bromine.

Further reactive groups which are of interest are those of the formula (2) in which V is a non-reactive substituent or in particular a group which can be eliminated as an anion.

V as a group which can be eliminated as an anion is for example fluorine, chlorine, bromine, sulfo, $C_1$–$C_4$alkylsulfonyl or phenylsulfonyl and preferably chlorine or in particular fluorine.

V as a non-reactive substituent can be, for example, a hydroxyl, $C_1$–$C_4$alkoxy, $C_1$–$C_4$alkylthio, amino, N-$C_1$–$C_4$alkylamino or N,N-di-$C_1$–$C_4$alkylamino radical where the alkyl is unsubstituted or substituted, for example, by sulfo, sulfato, hydroxyl, carboxyl or phenyl, or it can be a cyclohexylamino, morpholino or N-$C_1$–$C_4$alkyl-N-phenylamino or phenylamino or naphthylamino radical where the phenyl or naphthyl is unsubstituted or substituted, for example, by $C_1$–$C_4$alkyl, $C_1$–$C_4$alkoxy, carboxyl, sulfo or halogen.

Examples of suitable non-reactive substituents V are amino, methylamino, ethylamino, β-hydroxyethylamino, N,N-di-β-hydroxyethylamino, β-sulfoethylamino, cyclohexylamino, morpholino, o-, m- or p-chlorophenylamino, o-, m- or p-methylphenylamino, o-, m- or p-methoxyphenylamino, o-, m- or p-sulfophenylamino, disulfophenylamino, o-carboxyphenylamino, 1- or 2-naphthylamino, 1-sulfo-2-naphthylamino, 4,8-disulfo-2-naphthylamino, N-ethyl-N-phenylamino, N-methyl-N-phenylamino, methoxy, ethoxy, n- or isopropoxy and hydroxyl.

As non-reactive substituent, V is preferably amino, N-$C_1$–$C_4$-alkylamino which is unsubstituted in the alkyl moiety or substituted by hydroxyl, sulfato or sulfo, or is morpholino, phenylamino or N-$C_1$–$C_4$alkyl-N-phenylamino in which each phenyl is unsubstituted or substituted by sulfo, carboxyl, methyl or methoxy. Particularly preferred meanings are phenylamino or N-$C_1$–$C_4$alkyl-N-phenylamino in which each phenyl is unsubstituted or substituted by sulfo, carboxyl, methyl or methoxy.

Here and below, preferred radicals of the formulae (3a) to (3f) are those of the formulae (3a) to (3d) and (3f), in particular those of the formulae (3c) to (3d) and (3f), and preferably those of the formulae (3c) and (3f). Of particular interest are those of the formula (3c).

Preferred heterocyclic reactive radicals of the formula (2) are those in which X is fluorine and V has the abovementioned meanings and preferences, or X is chlorine and V is a radical of the formulae (3a) to (3f).

Heterocyclic reactive radicals which are of interest are furthermore those of the formula (4)

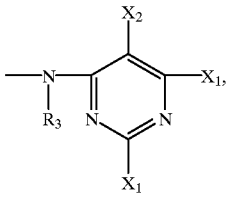

in which one of the radicals $X_1$ is a group which can be eliminated as an anion and the other radical $X_1$ has the meanings and preferences given for V as non-reactive substituent or is a radical of the formulae (3a) to (3f) or a group which can be eliminated as an anion, $X_2$ is a negative substituent, and $R_3$ independently is as defined above.

The radical $X_1$ which can be eliminated as an anion is preferably chlorine or in particular fluorine. Examples of suitable radicals $X_2$ are nitro, cyano, $C_1$–$C_4$alkylsulfonyl, carboxyl, chlorine, hydroxyl, $C_1$–$C_4$alkoxysulfonyl, $C_1$–$C_4$alkylsulfinyl, $C_1$–$C_4$alkoxycarbonyl or $C_2$–$C_4$alkanoyl, the preferred meanings for $X_2$ being chlorine, cyano and methylsulfonyl, in particular chlorine. Particularly preferably, at least one of the radicals $X_1$ is fluorine or a radical of the formulae (3a) to (3f). Very particularly preferably, one of the radicals $X_1$ is fluorine and the other radical $X_1$ is fluorine or chlorine with $X_2$ having the abovementioned meanings and preferences.

Of particular interest for the process according to the invention are those reactive groups which contain a radical of the formula —$SO_2$—Z or —NH—CO—Y or contain a triazine or pyrimidine radical in which at least one of the substituents is fluorine.

Particularly preferred reactive groups are those of the formulae (1) and (1a) to (1d), in particular those of the formulae (1), (1a) to (1c), and reactive radicals of the formula (2) in which X is fluorine and V has the abovementioned meanings and preferences, or in which X is chlorine and V is a radical of the formulae (3a) to (3f), and reactive radicals of the formula (4) in which at least one of the radicals $X_1$ is fluorine or a radical of the formulae (3a) to (3f), in particular those in which $X_1$ is fluorine and the other radical $X_1$ is fluorine or chlorine and $X_2$ has the abovementioned meanings and preferences.

Very particularly preferred reactive groups are those of the formulae (1), (1a) and (1b), in particular those of the formulae (1) and (1a), and preferably those of the formula (1a), and reactive radicals of the formula (2) in which X is fluorine or chlorine and V is a radical of the formulae (3a) to (3f), and reactive radicals of the formula (4) in which $X_1$ is fluorine and the other radical $X_1$ is fluorine or chlorine and $X_2$ has the abovementioned meanings and preferences.

Reactive groups which are of particular interest are those of the formulae (1),(1a) to (1f) and (2) where the radicals have the abovementioned meanings and preferences.

The reactive dyes can contain, apart from the reactive groups, substituents customary in organic dyes which are bonded to their basic skeleton.

Examples of such substituents of the reactive dyes include:

alkyl groups having 1 to 4 carbon atoms, such as methyl, ethyl, propyl, isopropyl or butyl where the alkyl radicals can be further substituted, for example, by hydroxyl, sulfo or sulfato; alkoxy groups having 1 to 4 carbon atoms, such as methoxy, ethoxy, propoxy, isopropoxy or butoxy, it being possible for the alkyl radicals to be further substituted, for example, by hydroxyl, sulfo or sulfato; phenyl which is unsubstituted or substituted by $C_1$–$C_4$alkyl, $C_1$–$C_4$alkoxy, halogen, carboxyl or sulfo; acylamino groups having 1 to 8 carbon atoms, in particular alkanoylamino groups such as, for example, acetylamino or propionylamino; benzoylamino which is unsubstituted or substituted in the phenyl ring by $C_1$–$C_4$alkyl, $C_1$–$C_4$alkoxy, halogen or sulfo; phenylamino which is unsubstituted or substituted in the phenyl ring by $C_1$–$C_4$alkyl, $C_1$–$C_4$alkoxy, halogen or sulfo; N,N-dihydroxyethylamino; N,N-di-β-sulfatoethylamino; sulfobenzylamino; N,N-disulfobenzylamino; alkoxycarbonyl having 1 to 4 carbon atoms in the alkoxy radical, such as methoxycarbonyl or ethoxycarbonyl; alkylsulfonyl having 1 to 4 carbon atoms, such as methylsulfonyl or ethylsulfonyl; trifluoromethyl; nitro; amino; cyano; halogen, such as fluorine, chlorine or bromine; carbamoyl; N-alkylcarbamoyl having 1 to 4 carbon atoms in the alkyl radical, such as N-methylcarbamoyl or N-ethylcarbamoyl; sulfamoyl; N-mono- or N,N-di-dialkylsulfamoyl each having 1 to 4 carbon atoms, such as N-methylsulfamoyl, N-ethylsulfamoyl, N-propylsulfamoyl, N-isopropylsulfamoyl or N-butylsulfamoyl where the alkyl radicals can be further substituted, for example by hydroxyl or sulfo; N-(β-hydroxyethyl)sulfamoyl; N,N-di-(β-hydroxyethyl)sulfamoyl; N-phenylsulfamoyl which is unsubstituted or substituted by $C_1$–$C_4$alkyl, $C_1$–$C_4$alkoxy, halogen, carboxyl or sulfo; ureido; hydroxyl; carboxyl; sulfomethyl or sulfo. The reactive dyes preferably contain at least one sulfo or sulfato group, in particular 1 to 6 such groups and preferably 2 to 6 such groups.

Examples of suitable reactive dyes include those of the formula $$A_1—U \quad (5)$$

in which $A_1$ is the radical of a monoazo, disazo, polyazo, metal complex azo, anthraquinone, phthalocyanine, formazan or dioxazine dye and U is a reactive radical, the reactive radicals U here and below having in particular the above-mentioned meanings and preferences. In addition, the radical $A_1$ can contain one or more further reactive groups U which are identical to or different from one another. The total number of reactive groups in the dyes is preferably 1 to 3, more preferably 1 or 2, and most preferably 2.

Further examples of suitable reactive dyes are those of the formula (6)

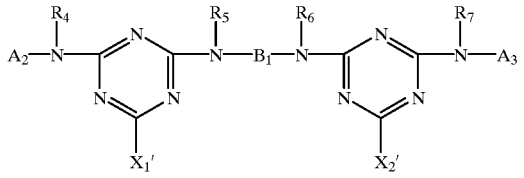

in which $R_4$, $R_5$, $R_6$ and $R_7$, independently of one another, are hydrogen or substituted or unsubstituted $C_1$–$C_4$alkyl, $X_1'$ and $X_2'$ are halogen, $B_1$ is an aromatic or aliphatic bridging member or the radical of the formula —$N(R_5)$—$B_1$-$N(R_6)$— is a piperazine radical, and $A_2$ and $A_3$, independently of one another, have the meanings given above for $A_1$.

The radicals $R_4$, $R_5$, $R_6$ and $R_7$ as alkyl radicals are straight-chain or branched. The alkyl radicals can be further substituted, for example by hydroxyl, sulfo, sulfato, cyano or carboxyl. Examples include the following radicals: methyl, ethyl, propyl, isopropyl, butyl, isobutyl, sec-butyl or tert-butyl and the corresponding hydroxyl-, sulfo-, sulfato-, cyano- or carboxyl-substituted radicals. Preferred substituents are hydroxyl, sulfo or sulfato, in particular hydroxyl or sulfato, and preferably hydroxyl.

Preferably, $R_4$, $R_5$, $R_6$ and $R_7$ are hydrogen or $C_1$–$C_4$alkyl, in particular hydrogen.

$X_1'$ and $X_2'$, independently of one another, are preferably chlorine or fluorine, in particular fluorine.

A preferred aliphatic bridging member $B_1$ is, for example, a $C_2$–$C_{12}$alkylene radical, in particular a $C_2$–$C_6$alkylene radical which may be interrupted by 1, 2 or 3 members from the group consisting of —NH—, —$N(CH_3)$— or in particular —O— and is unsubstituted or substituted by hydroxyl, sulfo, sulfato, cyano or carboxyl. Preferred substituents of the alkylene radicals given for $B_1$ are hydroxyl, sulfo or sulfato, in particular hydroxyl.

Further examples of suitable aliphatic bridging members $B_1$ are $C_5$–$C_9$cycloalkylene radicals, such as, in particular, cyclohexylene radicals. The cycloalkylene radicals mentioned can, if desired, be substituted by $C_1$–$C_4$alkyl, $C_1$–$C_4$alkoxy, $C_2$–$C_4$alkanoylamino, sulfo, halogen or carboxyl, in particular $C_1$–$C_4$alkyl. Aliphatic bridging members $B_1$ furthermore include methylenecyclohexylenemethylene radicals which are unsubstituted or substituted in the cyclohexylene ring by $C_1$–$C_4$alkyl.

A piperazine radical as a radical of the formula —$N(R_5)$—$B_1$—$N(R_6)$— is, for example, a radical of the formula

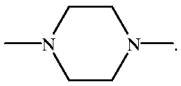

An aromatic bridging member $B_1$ is, for example, a $C_1$–$C_4$alkylenephenylene or phenylene each of which is unsubstituted or substituted by $C_1$–$C_4$alkyl, $C_1$–$C_4$alkoxy, $C_2$–$C_4$alkanoylamino, sulfo, halogen or carboxyl or is a radical of the formula (7)

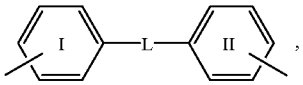

in which benzene rings I and II are unsubstituted or substituted by $C_1$–$C_4$alkyl, $C_1$–$C_4$alkoxy, $C_2$–$C_4$alkanoylamino, sulfo, halogen or carboxyl and L is a direct bond or a $C_2$–$C_{10}$-alkylene radical which may be interrupted by 1, 2 or 3 oxygen atoms, or L is a bridging member of the formula —CH═CH—, —N═N—, —NH—, —CO—, —NH—CO—, —NH—CO—NH—, —O—, —S—, or —$SO_2$—. As aromatic bridging member, $B_1$ is preferably phenylene which may be substituted as indicated above. Preferably, the aromatic bridging members given for $B_1$ are unsubstituted or substituted by sulfo.

Preferably, $B_1$ is a $C_2$–$C_{12}$alkylene radical which may be interrupted by 1, 2 or 3 members from the group consisting of —NH—, —$NH(CH_3)$— or —O— and is unsubstituted or substituted by hydroxyl, sulfo, sulfato, cyano or carboxyl; or is a $C_5$–$C_9$cycloalkylene, a $C_1C_6$alkylenephenylene or a phenylene radical each of which is unsubstituted or substituted by $C_1$–$C_4$alkyl, $C_1$–$C_4$alkoxy, $C_2$–$C_4$alkanoylamino, sulfo, halogen or carboxyl;

or $B_1$ is a radical of the formula (7) in which benzene rings I and II are unsubstituted or substituted by $C_1$–$C_4$alkyl, $C_1$–$C_4$alkoxy, $C_2$–$C_4$alkanoylamino, sulfo, halogen or carboxyl and L is a direct bond or a $C_2$–$C_{10}$alkylene radical which may be interrupted by 1, 2 or 3 oxygen atoms, or L is a bridging member of the formula —CH═CH—, —N═N—, —NH—, —CO—, —NH—CO—, —NH—CO—NH—, —O—, —S— or —$SO_2$—;

or the radical of the formula —$N(R_5)$—$B_1$—$N(R_6)$— is a piperazine radical of the formula

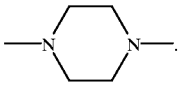

Particularly preferably, $B_1$ is a $C_2$–$C_{12}$alkylene radical which may be interrupted by 1, 2 or 3 members —O— and is unsubstituted or substituted by hydroxyl, sulfo, sulfato, cyano or carboxyl, or is a phenylene radical which is unsubstituted or substituted by $C_1$–$C_4$alkyl, $C_1$–$C_4$alkoxy, $C_2$–$C_4$alkanoylamino, sulfo, halogen or carboxyl.

Very particularly preferably, $B_1$ is a $C_2$–$C_{12}$alkylene radical, in particular a $C_2$–$C_6$alkylene radical, which may be interrupted by 1, 2 or 3 members —O— and is unsubstituted or substituted by hydroxyl.

Reactive dyes of the formula (6) which are of particular interest are those in which at least one of the radicals $X_1'$ and $X_2'$ is fluorine or $X_1'$ and $X_2'$ are chlorine and at least one of the radicals $A_2$ and $A_3$ contains a reactive group.

Suitable monoazo, polyazo or metal complex azo dye radicals as $A_1$, $A_2$ and $A_3$ preferably include the following:

Mono- or disazo dye radicals of the formula $$D—N=N—(M—N=N)_u—K— \quad (8) \text{ or}$$

$$—D—N=N—(M—N=N)_u—K \quad (9)$$

in which D is the radical of a diazo component from the benzene or naphthalene series, M is the radical of a middle component from the benzene or naphthalene series, K is the radical of a coupling component from the benzene, naphthalene, pyrazolone, 6-hydroxypyrid-2-one or acetoacetarylamide series and u is 0 or 1 where D, M and K may carry substituents customary for azo dyes, for example $C_1$–$C_4$alkyl or $C_1$–$C_4$alkoxy which, if desired, may be further substituted by hydroxyl, sulfo or sulfato, or halogen, carboxyl, sulfo, nitro, cyano, trifluoromethyl, sulfamoyl, carbamoyl, amino, ureido, hydroxyl, sulfomethyl, $C_2$–$C_4$alkanoylamino, benzoylamino which is unsubstituted or substituted in the phenyl ring by $C_1$–$C_4$alkyl, $C_1$–$C_4$alkoxy, halogen or sulfo, or phenyl which is unsubstituted or substituted by $C_1$–$C_4$alkyl, $C_1$–$C_4$alkoxy, halogen, carboxyl or sulfo, and fibre-reactive radicals. Also suitable are metal complexes derived from dyes of the formulae (8) and (9), which are in particular 1:1 copper complex azo dyes from the benzene and naphthalene series in which the copper atom is attached to one metallizable group each, for example a hydroxyl group, on both sides in the ortho position relative to the azo bridge. If the dye radicals of the formula (8) or (9) carry a reactive radical, the latter has the abovementioned meanings and preferences.

The dye radicals of the formulae (8) and (9) are preferably those of the formulae (10a)

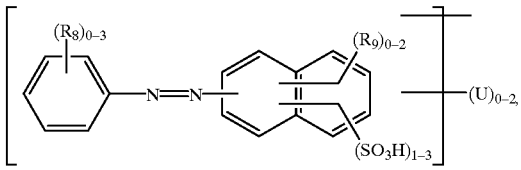

in which $(R_8)_{0-3}$ represents 0 to 3 identical or different substituents from the group consisting of $C_1$–$C_4$alkyl, $C_1$–$C_4$alkoxy, $C_2$–$C_4$alkanoylamino, ureido, sulfamoyl, carbamoyl, sulfomethyl, halogen, nitro, cyano, trifluoromethyl, amino, hydroxyl, carboxyl and sulfo, $(R_9)_{0-2}$ represents 0 to 2 identical or different substituents from the group consisting of hydroxyl, amino, N-mono-$C_1$–$C_4$alkylamino, N,N-di-$C_1$–$C_4$alkylamino, $C_2$–$C_4$alkanoylamino and benzoylamino, and $(U)_{0-2}$ represents 0 to 2 identical or different reactive groups;

(10b)

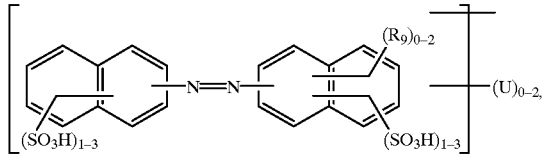

in which $(R_9)_{0-2}$ and $(U)_{0-2}$ are as defined above;

(10c)

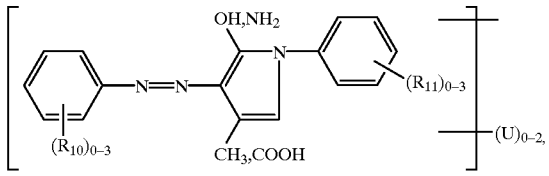

in which $(R_{10})_{0-3}$ and $(R_{11})_{0-3}$, independently of one another, represent 0 to 3 identical or different substituents from the group consisting of $C_1$–$C_4$alkyl, $C_1$–$C_4$alkoxy, halogen, carboxyl and sulfo, and $(U)_{0-2}$ is as defined above;

lp;1p (10d)

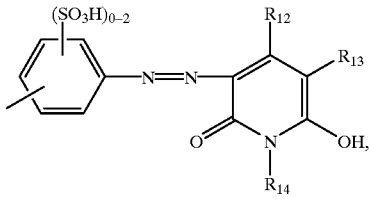

in which $R_{12}$ and $R_{14}$, independently of one another, are hydrogen, $C_1$–$C_4$alkyl or phenyl, and $R_{13}$ is hydrogen, cyano, carbamoyl or sulfomethyl;

(10e)

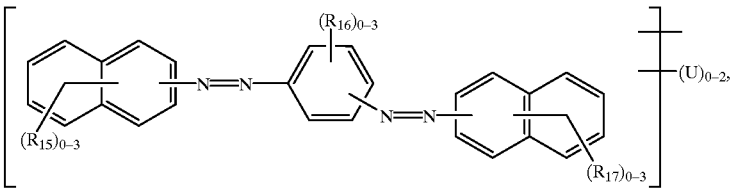

in which $(R_{16})_{0-3}$ represents 0 to 3 identical or different substituents from the group consisting of $C_1$–$C_4$alkyl, $C_1$–$C_4$alkoxy, halogen, carboxyl and sulfo, $(R_{15})_{0-3}$ and $(R_{17})_{0-3}$, independently of one another, have the meanings given above for $(R_8)_{0-3}$, and $(U)_{0-2}$ is as defined above;

in which $(U)_{0-2}$ is as defined above and the benzene rings do not contain any further substituents or are further substituted by $C_1$–$C_4$alkyl, $C_1$–$C_4$alkoxy, $C_1$–$C_4$alkylsulfonyl, halogen or carboxyl.

Examples of suitable phthalocyanine dye radicals $A_1$, $A_2$ and $A_3$ are those of the formula (10f)

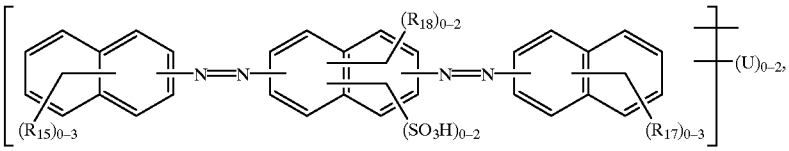

in which $(R_{15})_{0-3}$ $(R_{17})_{0-3}$ and $(U)_{0-2}$ are as defined above and $(R_{18})_{0-2}$ represents 0 to 2 identical or different substituents from the group consisting of $C_1$–$C_4$alkyl, $C_1$–$C_4$alkoxy, halogen, carboxyl, sulfo, hydroxyl, amino, N-mono-$C_1$–$C_4$alkylamino, N,N-di-$C_1$–$C_4$alkylamino, $C_2$–$C_4$alkanoylamino and benzoylamino.

Examples of suitable formazan dye radicals $A_1$, $A_2$ and $A_3$ are those of the formula (11)

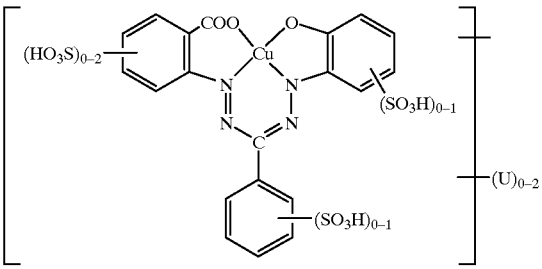

(12)

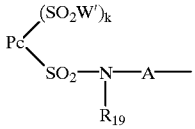

in which Pc is the radical of a metal phthalocyanine, in particular the radical of copper phthalocyanine or nickel phthalocyanine, W' is —OH and/or —$NR_{20}R_{20}$', $R_{20}$ and $R_{20}$', independently of one another, are hydrogen or $C_1$–$C_4$alkyl which is unsubstituted or substituted by hydroxyl or sulfo, $R_{19}$ is hydrogen or $C_1$–$C_4$alkyl, A is a phenylene radical which is unsubstituted or substituted by $C_1$–$C_4$alkyl, halogen, carboxyl or sulfo, or is a $C_2$–$C_6$alkylene radical, and k is 1 to 3.

Examples of suitable dioxazine dye radicals $A_1$, $A_2$ and $A_3$ are those of the formula (13)

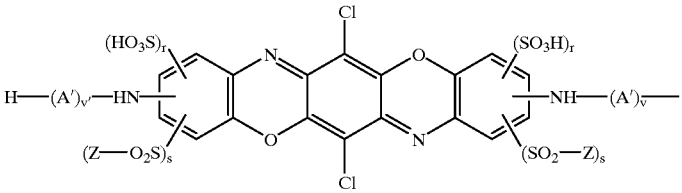

in which A' is a phenylene radical which is unsubstituted or substituted by $C_1$–$C_4$alkyl, halogen, carboxyl or sulfo or is a $C_2$–$C_6$alkylene radical, r, s, v and v', independently of one another, are each 0 or 1, and Z is as defined above.

Examples of suitable anthraquinone dye radicals $A_1$, $A_2$ and $A_3$ are those of the formula (14)

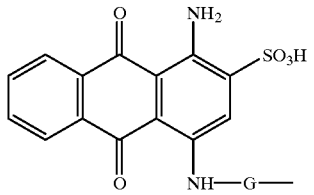

in which G is a phenylene radical which is unsubstituted or substituted by $C_1$–$C_4$alkyl, $C_1$–$C_4$alkoxy, halogen, carboxyl or sulfo or is a cyclohexylene, phenylenemethylene or $C_2$–$C_6$alkylene radical.

The above dye radicals of the formulae (10a) to (10f) and (11) to (14) each preferably contain at least one sulfo group, in particular 1 to 4 sulfo groups, and preferably 1 to 3 sulfo groups.

Suitable reactive radicals U are in particular the abovementioned reactive radicals having the abovementioned preferences.

Preference is given to dye radicals of the formulae (10a) to (10f), (11) and (14), in particular those of the formulae (10a) to (10f) and (11), and preferably those of the formulae (10a) to (10f).

The reactive dyes are known or can be obtained analogously to known preparation methods, such as diazotization, coupling and condensation reactions.

The amount of dye in the dyeing liquor may vary widely as a function of the desired colour depth and is, for example, up to 100 g/l of liquor, preferably 10 g/l to 70 g/l, in particular 10 g/l to 50 g/l of dyeing liquor.

It is recommended to use dyes having a low to medium fibre affinity. The dyeing liquors used according to the invention can contain one or several dyes.

The alkaline reagent used for fixing the reactive dyes comprises, for example, alkali metal carbonates or alkali metal bicarbonates, in particular $Na_2CO_3$, $NaHCO_3$, $KeCO_3$ or $KHCO_3$, alkali metal hydroxides, in particular NaOH or KOH, ammonia, organic ammonium salts, for example ammonium formate, ammonium acetate or ammonium tartrate, sodium trichloroacetate, borax, phosphates such as trisodiumphosphate, polyphosphate or sodium silicate or a mixture of two or more of the abovementioned alkaline reagents. It is recommended to use, as the alkaline reagent, a mixture of an aqueous solution of sodium hydroxide and sodium silicate.

Apart from the dye and the alkaline reagent, the dyeing liquor can contain other common additives, for example wetting agents, solubilizing agents, for example ε-caprolactam or polyethylene glycol, penetration accelerators, electrolytes, for example sodium chloride or sodium sulfate, and complexing agents, such as urea or glycerol.

After absorption of the dye and the alkaline reagent, the dye is fixed on the yarn based on cellulose fibres by a thermal method or else by a low-temperature method.

If fixing takes places by application of heat, a method which involves applying steam or holding at elevated temperature or a thermal insulation method is possible.

Examples of cellulose fibre yarns include cotton, in particular mercerized and/or bleached cotton, or else unbleached yarn which advantageously can be dyed by the process according to the invention without being washed beforehand. Such a dyeing operation cannot be carried out using the dyeing materials known up to now. Blend yarns based on cellulose, for example cotton/polyamide blend yarns or especially cotton/polyester blend yarns, are also suitable. Suitable yarns also include viscose materials, for example Tencel or Lyocell, and corresponding blend fibres with cotton, for example cotton/Lycra (polyurethane elastomer).

The process according to the invention makes it possible to dye cellulose yarns at a high speed, that is in high yield. Furthermore, it is possible to produce yarns exhibiting special effects, such as chiné yarn, "space" yarn, single- or multicolour speckled yarn, or yarn with partial impregnation of the fibres, for example of the washed-out type, of the ring-dyed denim type or of the stone washed denim type. These different effects could up to now only be achieved by means of a blend of several differently coloured fibres during spinning, but not by a dyeing process.

The impregnation apparatus 2 (see for example FIG. 1) comprises one or several dyeing liquors, in which the yarn is impregnated during its passage through apparatus 2. Upon leaving the latter, the dyeing liquor(s) present on the yarn diffuse into the interior of the fibres constituting this yarn. The essential components of these dyeing liquors, namely the reactive dye and the alkaline reagent, which are in aqueous solution, can be provided in separate containers or as a mixture in a single container. Providing the dye and the alkaline reagent in separate containers ensures a high stability of the dyeing liquor and avoids having to replace the latter at regular intervals because of hydrolysis by the alkaline reagent.

In the case where the dyeing liquor is applied as a mixture, i.e. where the reactive dye and the alkaline reagent are present in aqueous solution, it is possible to provide the two solutions in separate storage tanks and to mix them in an intermediate buffer storage tank prior to application. In this manner, only a small quantity of the dyeing liquor is affected by hydrolysis over time and can be removed or replaced where necessary, especially on prolonged standstill of the dyeing cycle.

Impregnation of the yarn with the dyeing liquor(s) is regulated in such a manner that the liquor pickup of the yarn is between 15 and 100% by weight, preferably about 15 to 80% by weight and most preferably about 15 to 50% by weight. At such an impregnation, the dyeing liquor, after the yarn has left the impregnation apparatus 2, can diffuse into the interior of the fibres.

Impregnation is preferably carried out at a temperature of 5 to 95° C., in particular 10 to 80° C. Particularly preferably, this temperature is 10 to 70° C., in particular 15 to 60° C. Very particular preference is given to a temperature of 15 to 50° C., in particular 15 to 40° C. When carrying out this treatment, not only the temperature of the yarn to be impregnated but also the temperature of the dyeing liquor during impregnation corresponds to one of the above temperatures. It is of particular interest that impregnation be carried out at ambient temperature, for example at 15 to 40° C., which makes it completely unnecessary to use a heating device before and in particular during the impregnation step. Preferably, the above preferences also apply to the step of winding the yarn onto one or several supports 3.

Also of interest is a process variant in which the yarn is treated at elevated temperature before the impregnating operation (impregnating apparatus 2). This treatment can be carried out, for example, before or after support 1. Preferably the treatment at elevated temperature is carried out continuously. The treatment can be carried out, for example, in a chamber which is fed with hot gas or preferably hot steam. In this chamber the yarn can be allowed to circulate. Such a chamber can be present between support 1 and impregnating apparatus 2. Such a chamber in addition, or as an alternative, can be present between impregnating apparatus 2 and support 3.

After being wound, each yarn is stored in unit 4. During storage, the colorant(s) absorbed on the yarn as a result of impregnation in apparatus 2 diffuse into the fibres of the yarn. This treatment is known as low-temperature fixing, which is preferred in the present process. This type of fixing causes the dyes in the fibres to be fixed, depending on yarn quality and type and on the dyes selected, at a degree of fixation in the order of 80 to 95%, relative to the colouring matter.

This low-temperature fixing of the dye on the yarn, which takes place by storing the impregnated and wound yarn, is carried out for example at an ambient temperature, for example at a temperature between 10 and 40° C., in particular between 15 and 35° C. The duration of the low-temperature treatment can depend on the dye used and varies within wide limits, which range from 3 to 24 hours, preferably from 4 to 10 hours, particularly preferably from 6 to 8 hours.

A corresponding fixing treatment at elevated temperature, in which the dye is fixed on the cellulose fibre yarn by storage at a temperature above 40° C., in particular of up to 70° C., and preferably of up to 60° C., in a storage unit (4) containing the impregnated and wound yarn, is also possible. The duration of the treatment can depend on the dye used and varies within wide limits. Preferably, the duration of the treatment is up to 3 hours, in particular 0.5 to 3 hours, and preferably 1 to 3 hours.

Feeding of the apparatus according to the invention depends on the intended requirements or intended production rates and can take place with a single yarn or several yarns of any linear fibre density or type, in different forms.

Thus, one or several yarns can be unwound from multiple supports 1 or a single support and rewound onto multiple supports 3 or a single support. However, unwinding from multiple supports 1 and rewinding onto a single support 3 and vice versa are also possible. Moreover, prior to unwinding from supports 1, preparatory operations which can consist especially in rewinding from a supercops may also be carried out.

According to a feature of the invention, the yarn(s), after leaving storage unit 4, are dried directly without an intermediate washing operation and are in particular directly used as such for weaving or knitting goods. In such a case, the resulting textile product is washed, drained and dried, following the weaving or knitting or following the make-up operation. In such a case, the unfixed dyes and the alkalis, silicates and further auxiliaries are removed by the washing operation from the woven fabric, knitted fabric or textile end product. Such a procedure is of particular interest for velours fibre materials.

This drying operation can likewise be carried out in an autoclave by means of saturated or pressurized steam, in a chamber in the form of a tunnel which is supplied with high-frequency or infrared energy or in a tunnel supplied with hot air or hot gas, fixing then taking place at the same time.

If drying is carried out in an autoclave with steam, the textile yarn impregnated with the dyeing liquor is subjected to a treatment in a chamber with, if desired, superheated steam at an operating temperature between 98 and 210° C., advantageously between 100 and 180° C., preferably between 102 and 120° C.

If the treatment takes place by holding at elevated temperature, the impregnated cellulose-based yarn is left in wet condition in an autoclave for 1 to 120 min, for example at a temperature between 80 and 102° C.

Fixing of the dye by the thermal insulation method can be effected with or without intermediate drying, for example at a temperature between 100 and 210° C., advantageously between 120 and 200° C., and especially between 140 and 180° C. Depending on the treatment temperature, thermal insulation extends over a period between 20 s and 5 min, preferably between 30 s and 60 s.

According to another feature of the invention, the yarn(s), after leaving the storage unit 4, can also be unwound from an intermediate rack 5 and then washed and, for example, drained continuously while moving at high speed in a washing and draining unit 6, before being subjected to drying in an apparatus 7 after which the yarn(s) are rewound onto new supports 8 (FIG. 1).

The apparatus for implementing this process has an intermediate rack 5, which is comparable to the apparatus for unwinding yarns from the supports 1, and the new rewinding supports 8 are activated by an apparatus similar to the unit for rewinding the yarn(s) onto one or more supports 3.

Figure 2:
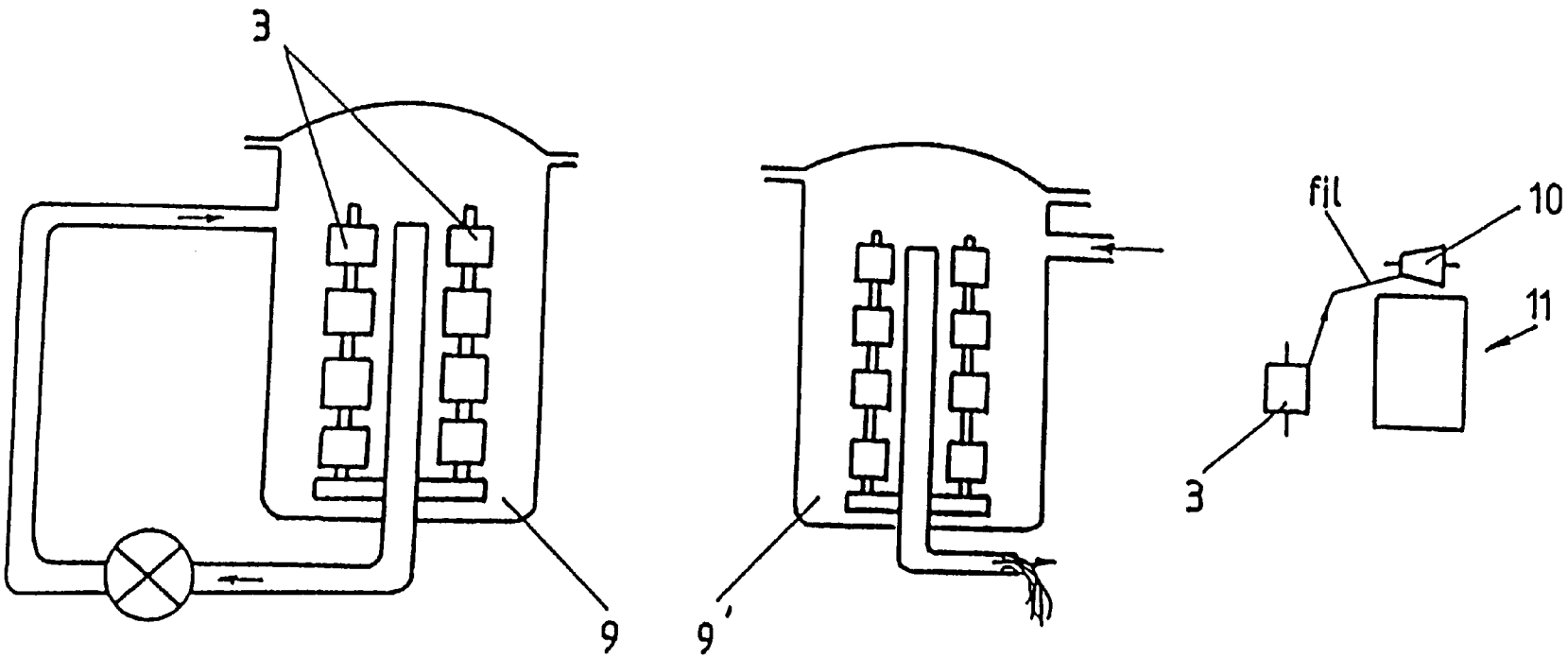
FIG. 2 is a side elevation view showing a possible embodiment of the washing/dehydration and drying operations.

FIG. 2 of the accompanying drawings shows an embodiment of the process according to the invention and of the apparatus according to the invention, in which the supports 3 leaving storage unit 4 are subjected to a washing operation in an autoclave 9 and to a drying operation of the yarn in a high-speed dryer 9', the yarn then being rewound from supports 3 onto new supports 10 in a rewinding unit 11. In such a case, supports 3 can be arranged on perforated columns of a material support, with a view to their being washed by counter-current circulation in autoclave 9, after which the material support is transferred to the high-speed dryer 9', in which the moisture is removed from the yarns present on the supports by applying pressure to the chamber forming the high-speed dryer 9' and sucking air through the yarns on supports 3 by means of the perforated columns of the material support.

The yarns rewound onto supports 8 or 10 are yarns which have been freed from excess dyes and other components of the dyeing liquors and are perfectly stable with respect to the dyeing produced on them, i.e. there is no longer any risk of dye being washed off, and they are suitable for use in weaving or knitting, a later washing of the woven or knitted fabric no longer being necessary.

These cellulose fibre yarns then have a moisture content of, for example, 8 to 12% in a standard textile environment, that is to say at 22° C. and a relative humidity of 65%.

As shown in FIG. 3, the impregnation apparatus 2 can be composed of a dyeing liquor trough 12 which is maintained at a constant level by a feed pump 13 which is linked to a storage tank containing the dyeing liquor 14 which, if desired, is heated by a heat source 15, the yarn(s) to be impregnated being unwound in the dyeing liquor by means of return idlers, and of a means 16 for squeezing off excess dye on the yarn(s) with compressed air whose pressure can be regulated, the entire unit being arranged in a chamber 17 for recovering the squeezed-off dye and being provided with openings through which the yarn(s) can pass. Such an embodiment of the impregnation apparatus is especially suitable for combined dyeing with a dyeing liquor in the form of a mixture of dye and alkaline reagent.

The squeezing-off means 16 consists of a vessel which is provided with two openings through which the yarn(s) charged with dyeing liquor pass and which is subjected to superatmospheric pressure. As a result of the superatmospheric pressure generated in the vessel through which the yarns pass, a substantial portion of the dyeing liquor remaining on the yarn is squeezed off from the latter and discharged through the openings of the vessel. This makes it possible to obtain, at the outlet of apparatus 2, a yarn exhibiting a liquor pickup in the order of 15 to 100% by weight, which is regulated as a function of the air pressures used in means 16.

FIG. 4 shows an embodiment of the impregnation apparatus 2, in which the latter comprises a plurality of means 18 for guiding and holding each yarn longitudinally, at least one nozzle 19 for atomizing and spraying the dyeing liquor onto the moving yarn(s), an apparatus 20 for squeezing off excess dyeing liquor, and a unit 21 for the the continuous supply of dyeing liquor, which is connected to the atomizing and spraying nozzles 19 and to a trough 22 for receiving excess atomized and/or squeezed-off dyeing liquor, this trough 22 forming the bottom of the chamber constituting the impregnation apparatus 2. By providing a succession of atomizing and spraying nozzles 19, depending on the desired effect an enhanced impregnation of the yarn can be achieved, as a result of which penetration of the dyeing liquor in and between the fibres constituting the yarn can, if desired, be optimized.

Using such an apparatus makes it possible to modify the spraying pressure of the dyeing liquor, the number of nozzle rows and their distance from the yarn, and also the diameter of the nozzles and their atomizing or spraying angle with respect to the moving yarn, so that different ring- or core-dyeing levels can be obtained on the yarn.

Figure 12:
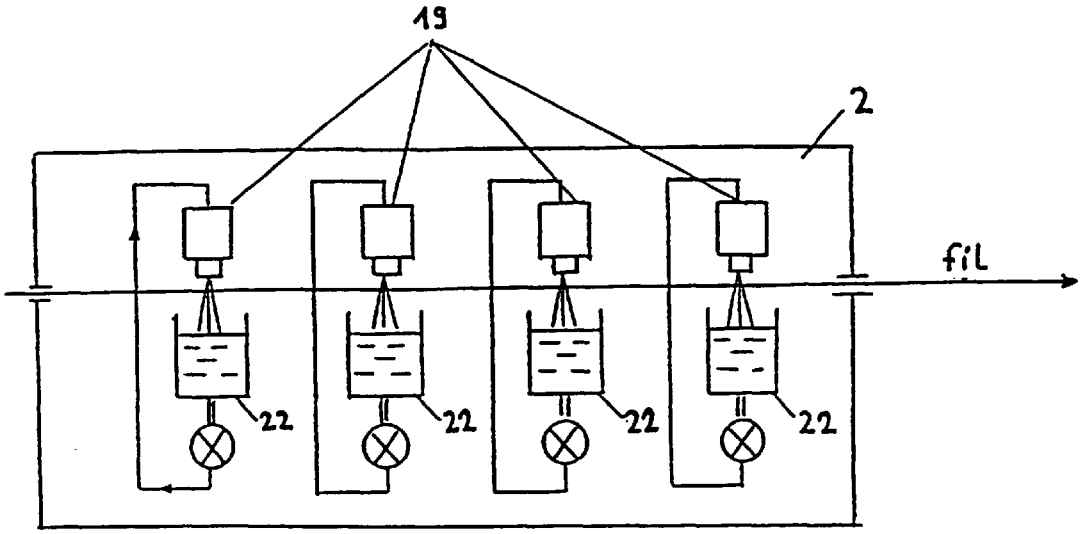

Moreover, by means of this impregnation apparatus according to FIG. 4 (or FIG. 12, respectively), spraying of the reactive dyes and the alkaline reagent can be carried out separately, the latter being sprayed before or after the reactive dye. As a result, the dye and the reagent are not mixed beforehand, thus possibly avoiding any hydrolysis of the dye by the reagent. To this end, it is particularly advantageous to impregnate the yarn first with an aqueous solution of reactive dye and then with the alkaline reagent. In such a case, the excess dye returning to the trough for receiving excess liquor is not contaminated by the alkaline reagent und does not undergo hydrolysis, thus ensuring long-term stability of the liquor.

The apparatus 20 for squeezing off excess dyeing liquor is preferably in the form of a support anvil 23 for the moving yarn(s) which is slightly elevated with respect to the horizontal feed direction of the yarn(s) and is equipped, on the upstream side of the yarn(s), with a chamfer 23' or rounding and with a nozzle 24 for blowing compressed air, which directs a jet of air onto the yarn(s). Thus, because of the slight forced change of direction of the yarn by means of anvil 23 and the blowing of compressed air, it is possible either to remove or squeeze off excess dyeing liquor at the site of this change of direction, by nozzle 24, by means of a combination of mechanical and pneumatic draining.

The squeezing-off apparatus 20 can, of course, also be used in the embodiment of the impregnation apparatus according to FIG. 3, instead of squeezing means 16, and vice versa.

To promote efficient impregnation of the yarn(s) and then optimum diffusion of the dyeing liquor into the individual fibres constituting the yarn, the impregnation apparatus 2 according to FIG. 4 is advantageously equipped with a plurality of atomizing and spraying nozzles 19.

According to another embodiment of the invention, it is likewise possible to provide below the yarn(s), at right angles to each atomizing and spraying nozzle 19, a support plate 25 for holding the yarn. This embodiment is shown in FIG. 4 of the accompanying drawings, at right angles to a nozzle 19.

In this manner, the yarn(s) are kept in place and protected from any deviation which would move them away from the corresponding nozzles 19, thus ensuring better impregnation by the jet and better penetration of the dyeing liquor into the fibres.

In fact the kinetic energy of the dyeing liquor sprayed onto the yarn displays an optimum effect if the yarn rests on a fixed support and if the jet of dye can hit the yarn without the possibility of the yarn moving away.

The guiding and holding means 18 in turn prevent any deviation into a horizontal plane outside the longitudinal axis of the yarn(s).

FIG. 4 (or FIG. 12, respectively) of the accompanying drawings furthermore shows another embodiment of the invention, in which at least two atomizing and spraying nozzles 19 are diametrically oppositions with respect to the longitudinal axis of movement of the yarn(s) to be dyed or treated. In such an embodiment, impregnation and penetration of the dyeing liquor between and into the fibres at right angles to each pair of nozzles 19 is optimized due to the fact that the kinetic energies of the two opposite jets add up.

According to another embodiment of the invention, not shown in the accompanying drawings, it is also possible to provide, in the impregnation apparatus 2, a succession of vaporizing nozzles 19 between each of which is interposed a squeezing-off apparatus 20 formed by an anvil 23, and an air-blowing nozzle 24. Such an embodiment makes it possible to subject each moving yarn to successive mechanical impregnating and draining operations, resulting in better impregnation of the yarn with the dyeing liquor and thus in optimization and acceleration of the impregnation and diffusion of the dyeing liquor through all the fibres and into the interior of all the yarn fibres, depending on the desired effect.

Figure 10:
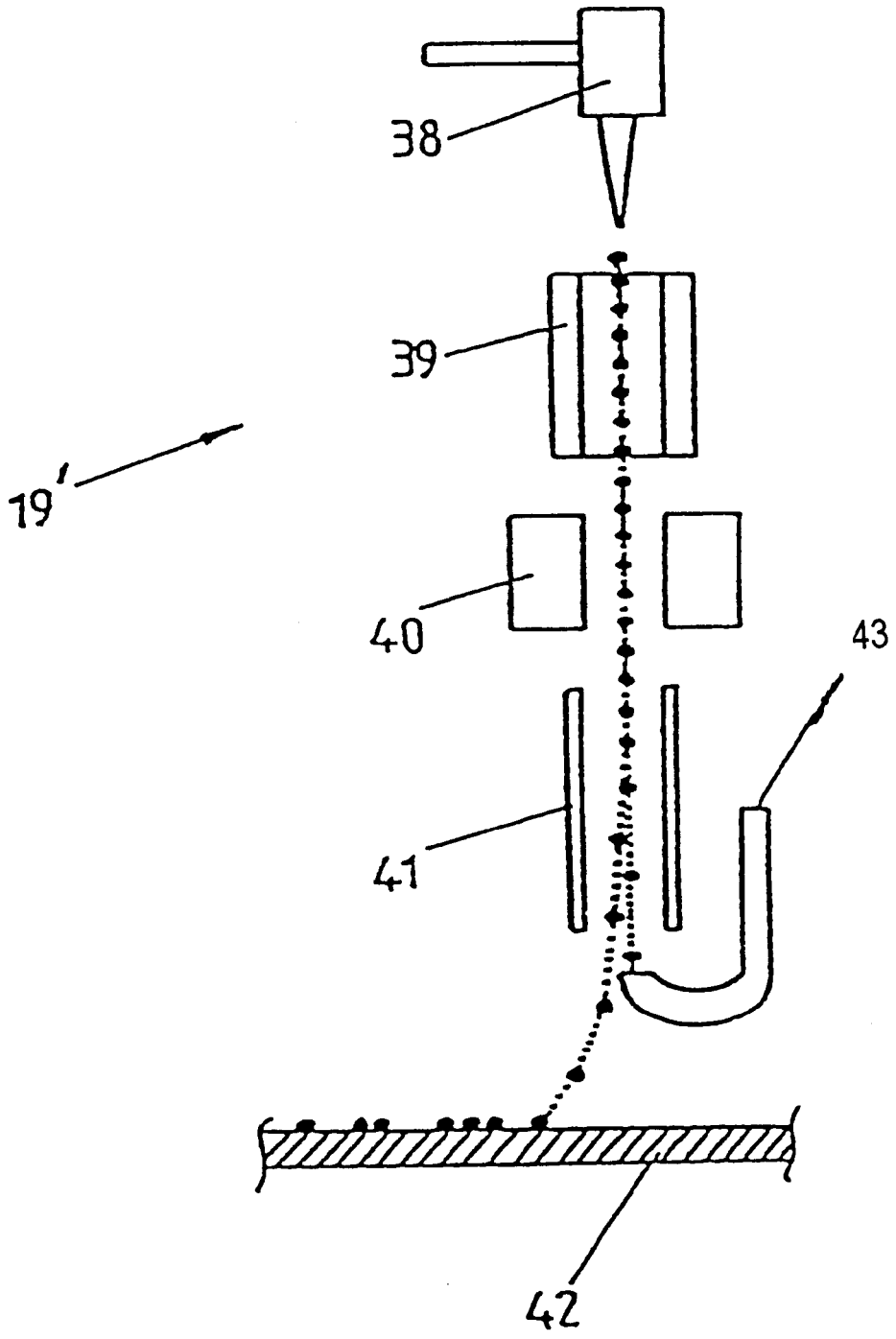
FIG. 10 is a larger-scale sectional view of an embodiment of the atomizing and spraying nozzle usable with the impregnation apparatus according to FIG. 4 (or FIG. 12, respectively)

According to another feature of the invention, nozzles 19 can also be designed in the form of piezoelectric nozzles (of the drop-on-demand type), thermal nozzles (of the bubble-jet type) or high-frequency nozzles with continuous or deflected jet. FIG. 10 of the accompanying drawings shows by way of example a high-frequency nozzle 19' in which a high-frequency droplet generator 38 delivers droplets through a charging device 39, a detector 40 and a deflector 41 which directs the droplets either onto a yarn 42 or towards a recycling means 43. In this manner, a very precise application of dyeing liquor can be effected.

Figure 5:
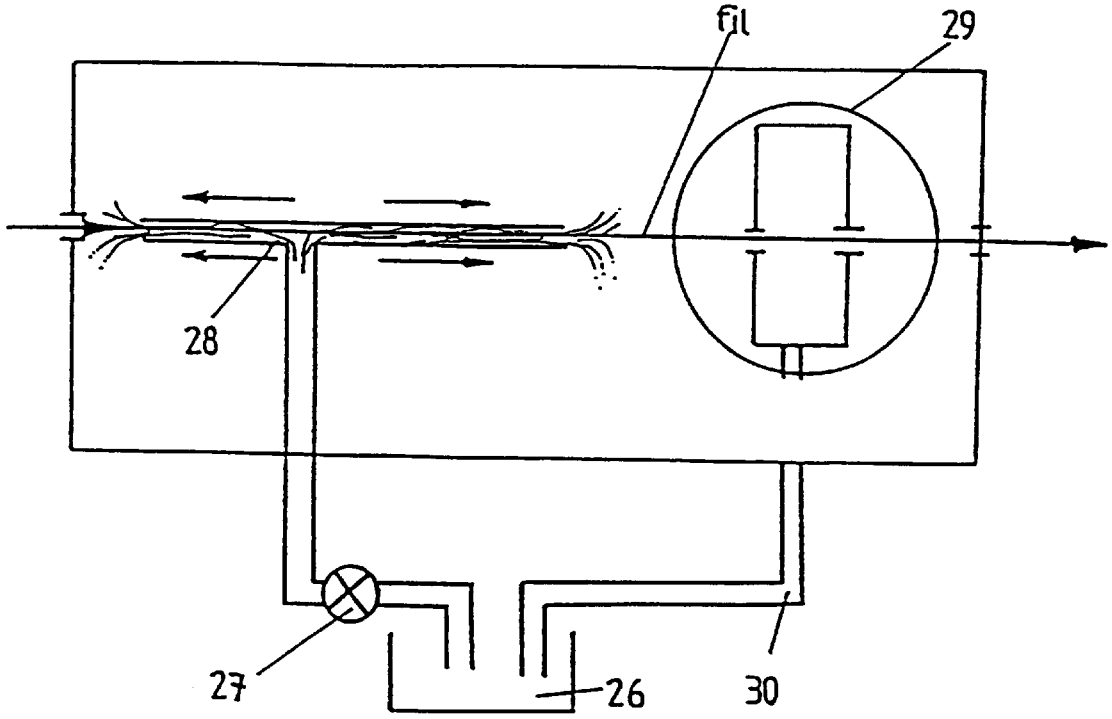

FIG. 5 of the accompanying drawings shows another embodiment of the impregnation apparatus 2 in which a dye storage tank 26 is connected by means of a feed line and a pump 27 to a pressurized impregnation channel 28 formed, for each yarn or for a plurality of yarns, by a longitudinal tube through which the yarn(s) pass in its longitudinal direction, a unit 29 for squeezing off excess dyeing liquor being arranged downstream from this channel 28, the dyeing liquor discharged from the pressurized channel 28 and that coming from the squeeze-off unit 29 being recovered at the bottom of the chamber forming the apparatus 2 and returned to storage tank 26 through a line 30.

According to a feature of the invention, the pressurized channel 28 can be designed in tubular form, which is particularly suitable for dyeing unitary fibres, or in the form of a rectangular elongated box for dyeing multiple fibres in sheet or strand form. The cross-section and the length of such channels can be chosen in such a manner that the time of contact of the yarn with the dyeing liquor can be varied as a function of the yarn speed, and the relative speed of the dyeing liquor which circulates in the channel can be varied with respect to the yarn speed in that same channel. All these factors can influence the contact effect of the dyeing liquor with the yarn and its constituent fibres.

It is also possible to make the pressurized dyeing liquor reach the channel 28 at intervals, in order to take into account the different speeds of the dyeing liquor and the yarn, owing to the fact that upstream, relative to the direction of movement of the yarn, the speeds of the yarn and the dyeing liquor under pressure add up, while downstream they subtract.

According to another feature of the invention, the pressurized impregnation channels 28 can be provided, on their inside surface which extends parallel to the direction of movement of the yarn, with rough sections or obstacles or surface deformations. The latter generate a nonlaminar flow of the dyeing liquor, and the turbulences thus obtained favour the formation of strong local pressures and agitation which is also favourable for the yarn, resulting in rapid high-quality impregnation, if this effect is desired.

In the embodiment according to FIG. 5, the squeezing-off unit 29 can be composed either of a pressurized vessel through which the yarn charged with the dyeing liquor passes or by a combination of anvil and air-blowing nozzle. Moreover, owing to the fact that the yarns are immersed in a dyeing liquor under pressure during impregnation, the fibres constituting the yarn(s) are rapidly and intimately surrounded by the dyeing liquor, with the result that diffusion of the colourants into the fibres starts more efficiently during impregnation. Furthermore, the relative speed between the moving yarn and the dyeing liquor in channel 28, which is in the form of a tube or in a different form, reinforces the uniform impregnation of the fibres constituting the yarn.

Figure 6:
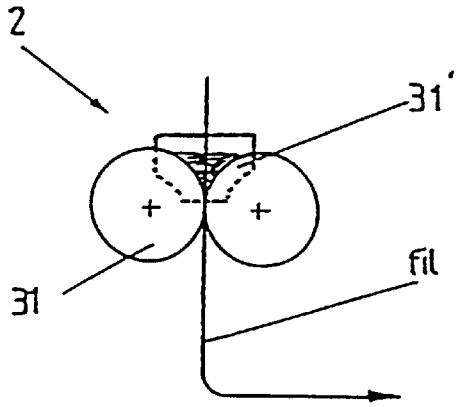

FIG. 6 of the accompanying drawings shows another embodiment of the impregnation apparatus 2, in which the latter is in the form of an impregnating pad-mangle 31 composed of two horizontal cylinders which along their surface line are in contact with one another and above which provision is made for a constant supply of dyeing liquor, and of an arrangement of lateral leakproof flanges 31' at the cylinder ends, the yarn(s) being impregnated by passage between the cylinders.

Figure 9:
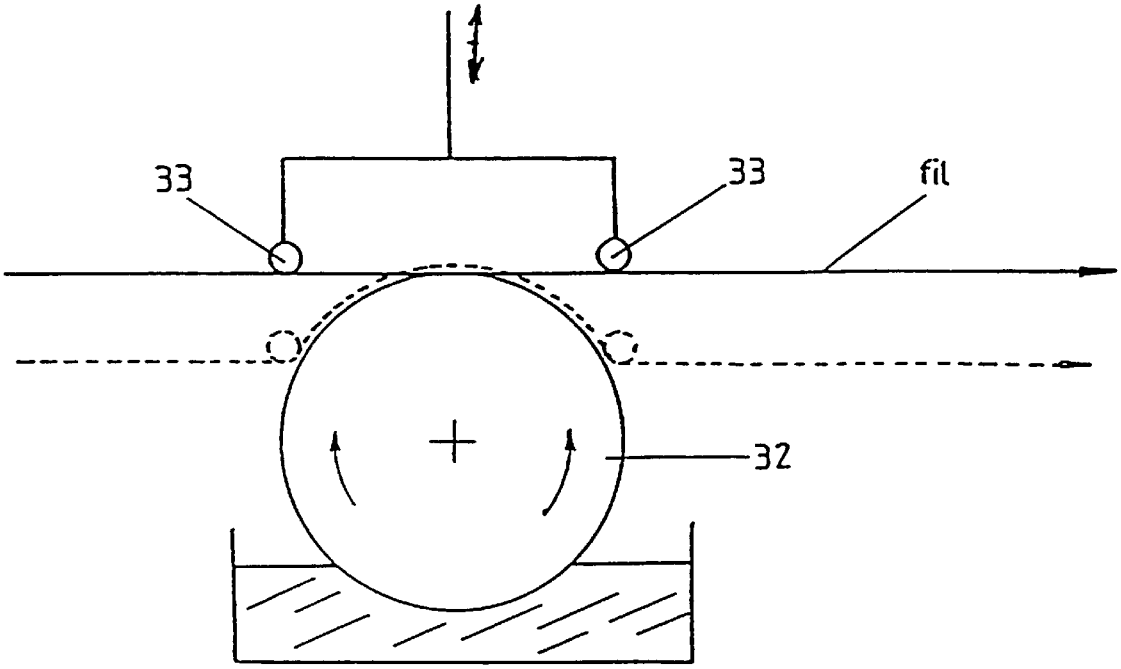

According to another embodiment of the invention, it is also possible, as shown in FIG. 9 of the accompanying drawings, to design the impregnation apparatus 2 in the form of a contact impregnation drum 32 which dips in a dyeing liquor and applies the dye by contact to the moving yarn(s) which are guided by means of return idlers 33 or a similar device over a portion of the circumference of the drum, the position of these return idlers 33 being adjustable with respect to the drum 32.

Thus it is possible to modify the degree of impregnation of the yarns by moving the idlers 33 away from or closer to drum 32, so that a longer or shorter, greater or lesser contact of the yarn with the drum, which has entrained a certain amount of dyeing liquor during rotation, is obtained. The degree of impregnation can also be modified by acting on the rotational speed of drum 32 and, accordingly, on the relative speed of the yarn with respect to the drum. This action on the relative speed can be enhanced by modifying the direction of rotation of drum 32. The reason for this is that, in the case where rotation of drum 32 is opposite to the direction of movement of the yarn, the latter exerts on the film of dyeing liquor entrained by the drum an impregnating effect, resulting in better penetration of the yarn fibres by the liquor.

Finally, by adjusting the viscosity of the dyeing liquor, the degree of liquor pickup by the moving yarn can be varied.

The apparatus according to FIG. 9 is very particularly suitable for carrying out partial impregnations of the yarn, of the ring-dyeing type, or merely of a portion of the periphery of a yarn. If there is only a light contact of the yarn with drum 32 and drum 32 is coated lightly with the dyeing liquor, it is in fact possible to impregnate only a portion of the circumference of the yarn on the surface.

Figure 11:
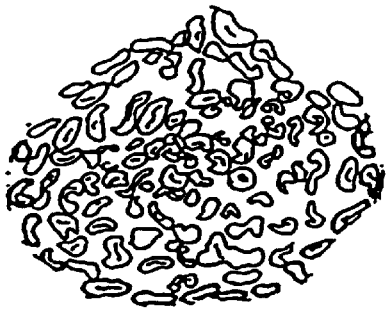
FIG. 11 is a greatly enlarged sectional view of a yarn treated by the process according to the invention.

FIG. 11 of the accompanying drawings, which shows a sectional view of a yarn treated according to the invention on a greatly enlarged scale, perfectly illustrates partial impregnation of the yarn on the peripheral fibres of the lower portion of the yarn. The fibres impregnated on the surface are therefore shown with thick outlines, whereas the undyed fibres are shown in thin lines.

In the case of core-dyeing, as is obtainable in particular by the means of impregnation 2 according to FIGS. 3 to 6 and 12, all the fibres constituting the yarn are impregnated by the dyeing liquor which, after being absorbed on the periphery of the fibres, diffuses into their interior.

Figure 7A:
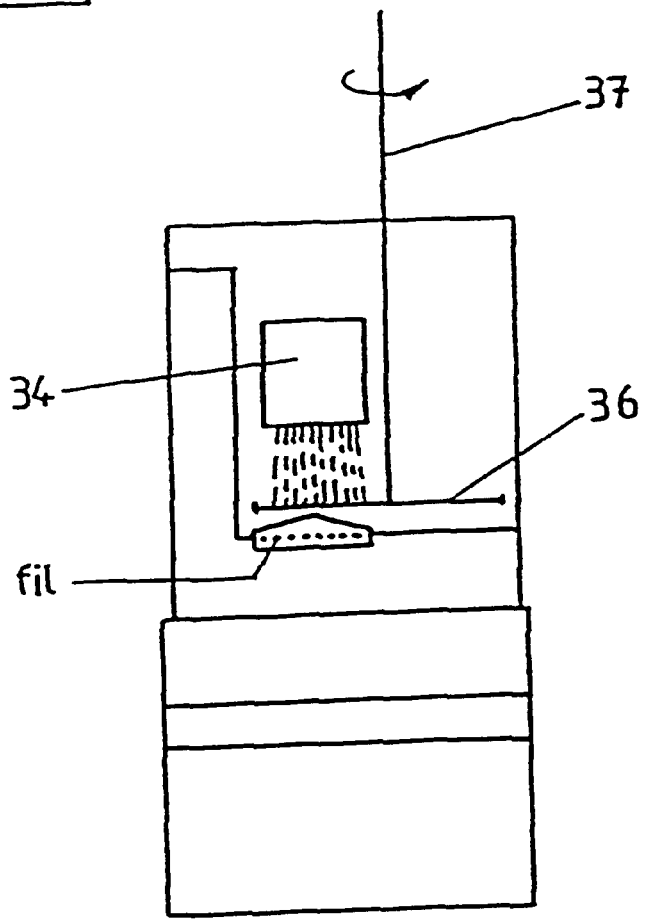

According to another embodiment of the invention, and as shown in sectional view in FIG. 7*a* of the accompanying drawings, impregnation apparatus 2 can likewise be composed of a dyeing machine equipped with multiple applicators each assigned to a different dyeing liquor and each delivering in succession, in sequences of identical or unequal lengths, spots of different dyes. Such an impregnation apparatus enables in particular the production of yarns with fancy effects such as those known by the name of "single- or multicolour space yarns", yarns of the chiné type or of the speckled type or else of the washed-out or denim type.

A dyeing machine comprising multiple applicators which can be used for this purpose is disclosed in particular in FR-A-2,650,311 and FR-A-2,719,058.

Figure 7B:
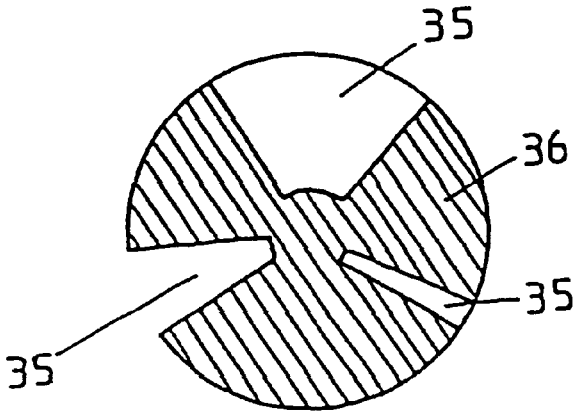

FIG. 7*a* of the accompanying drawings shows a possible design of an applicator of such a machine. Thus, the dyeing liquor fed into an atomizing apparatus 34 comprising nozzles which are each arranged at right angles to the axis of movement of one or several yarns is sprayed in succession by means of these nozzles through a slot 35 provided in a disc 36 (FIG. 7*b*) which extends between the nozzles and the path of the yarn(s) and is mounted to rotate around a vertical axle 37. Thus, by activating disc 36 and the nozzles of apparatus 34, it is possible to spray spots of a given dyeing liquor applied to the yarn(s) at more or less regular intervals and for a predetermined period. By using a succession of such applicators each linked to a different dyeing liquor, the applicators being synchronized with one another, it is thus possible to produce special yarns with fancy effects of the single-colour space, multicolour space, chiné or speckled type or else of the washed-out or denim type.

Figure 7C:
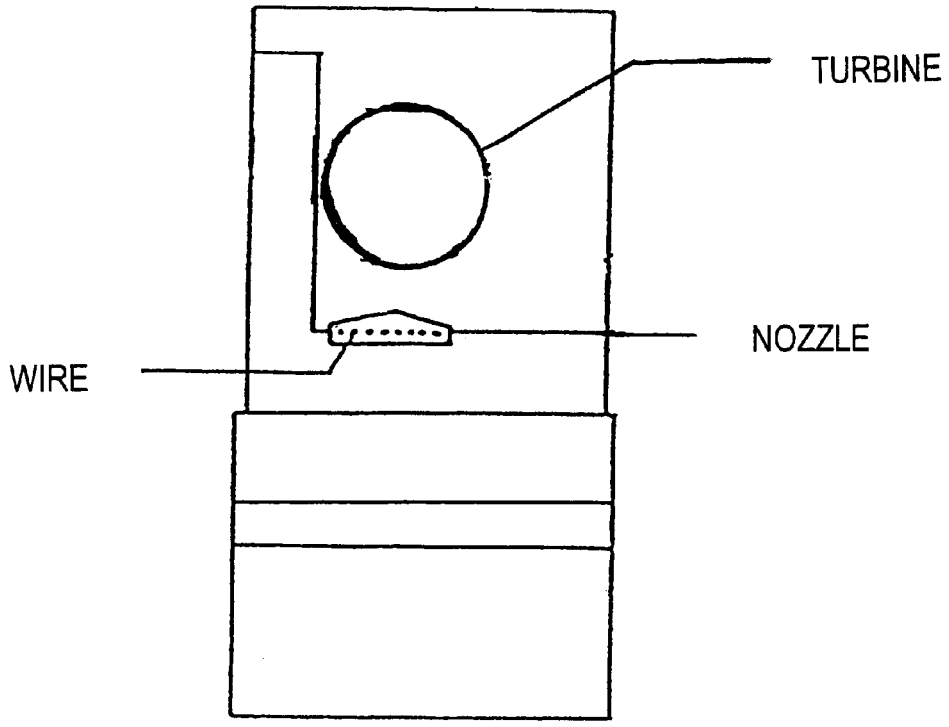

Such a successive application of different dyeing liquors can also be carried out by spraying the dye using a rotating turbine or else using a plate as shown in FIG. 7C. In such a case, the turbine can be of the type described in FR-A-2,650,311; that is, it can be in the form of a hollow cylindrical body equipped on its periphery with a plurality of openings or dye-spraying nozzles of identical or different cross-sections, this turbine being mounted to rotate about an axis extending parallel to the axis of movement of the yarns, and spraying the dyeing liquor through these different nozzles. This makes it possible to produce on the moving yarns coloured spots whose sizes and spacings correspond to the geometry and arrangement of the openings or spraying nozzles of the turbine.

Figure 8:
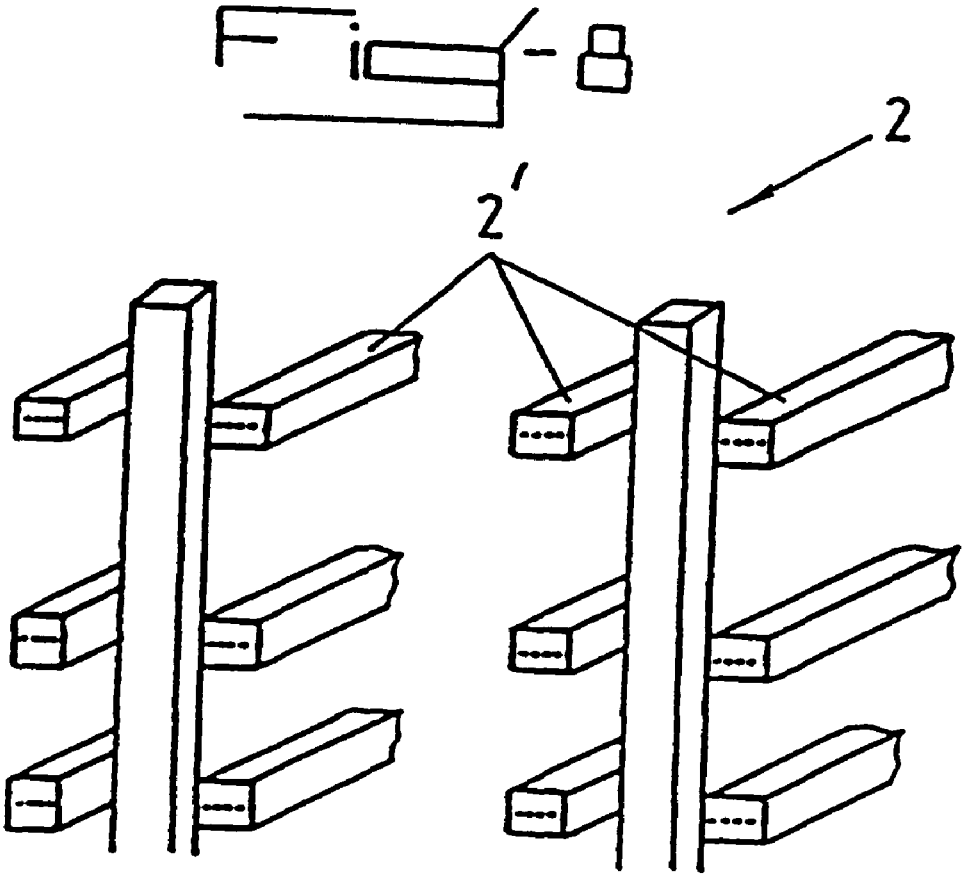

FIG. 8 of the accompanying drawings shows an embodiment of the invention in which the impregnation apparatus 2 is divided into a plurality of yarn impregnation chambers 2'. By means of such an embodiment, a multitude of yarns can be treated simultaneously with different dyes, which takes place with groups of yarns each corresponding to one or several chambers 2'. In such a case, it is indeed possible to feed each chamber 2' or set of chambers 2' with different dyeing liquors, depending on the requirements.

If such an apparatus comprising multiple chambers is used, the different yarns obtained must, of course, be subjected to separate washing operations.

The washing and draining unit 6 can have an analogous construction to that of the impregnation apparatus 2, such as is shown in its various embodiments in FIGS. 3 to 5, where the liquor troughs and the atomizing and spraying nozzles are simply fed with water, or water containing detergent products, and the draining operation is carried out by means of squeezing-off means which remove the water from the yarn.

After dyeing, the yarn can be washed, for example by treating it at a temperature between 60 and 80° C., with a solution containing soap or one or several detergents. Washing can be effected continuously on the moving yarn or by treating it while it is wound on bobbins.

If the washing and draining unit 6 is composed of a succession of atomizing and spraying nozzles, washing by means of these nozzles is advantageously carried out by counter-current washing reusing the washwater successively from the last washing nozzle, as viewed in the direction of advance of the yarn, up to the first washing nozzle, followed by discharging and treating the residual water. In fact, in such an embodiment, it is sufficient to recover the washwater obtained from the treatment at the last nozzle, as viewed in the direction of advance of the yarn(s), and to reinject it into the penultimate nozzle and so on up to the first one. This water is then progressively enriched with residual dye and associated chemical products and is used for successive washings of the yarn without affecting the quality of washing. This leads to a substantial saving in washwater. In such a case, the squeezing means arranged following the last nozzle effects the draining of the yarn(s).

By inserting squeezing-off apparatuses 20 between the different washing nozzles, it is possible to optimize the washing by means of the mechanical squeezing action, which makes the yarn more susceptible to another wetting.

The drying apparatus 7 (not shown in detail) is advantageously in the form of a tunnel through which the yarn(s) pass and which is supplied with hot air or a hot gas under pressure. This drying apparatus 7 makes it possible to obtain one or several yarns having the relative moisture content required for later use. If apparatus 7 is designed in the form of a tunnel, it can advantageously be equipped with obstacles or rough regions which have a favourable effect on the formation of drying air or drying gas turbulences and vibrations of the yarn, thus optimizing the drying action.

According to another embodiment of the invention, not shown in the accompanying drawings, the drying apparatus 7 can also be in the form of a chamber for concentrating the yarn through formation of successive loops on tensioning rollers, this chamber being subjected to circulating hot air or hot gas.

According to another embodiment of the invention (not shown in the accompanying drawings), the drying apparatus 7 can also be in the form of a tunnel through which the yarn(s) are passed and which is supplied with high-frequency or infrared energy.

According to another embodiment of the invention, not shown in the accompanying drawings, it is likewise possible to dry the treated yarn either by blowing in hot air during winding or by passing the bobbins through a high-frequency or infrared drying tunnel.

By virtue of the invention, it is possible to carry out continuous dyeing of one or several cellulose fibre textile yarns at high speed, i.e. of the order of 600 m/min or more, with reactive dyes while obtaining a substantial saving of dye, that is, with an extremely reduced discharge of dye into the washwater, as well as with a substantial saving of energy and water consumption.

Furthermore, by means of the process according to the invention and the apparatus according to the invention, uniform impregnation of the fibre assembly constituting each yarn and fixation of the dyes on and in the fibres make it possible to obtain more brilliant shades and higher wash, rub and light fastness properties and the like.

The yarns dyed according to this process are less subject to mechanical stress and retain to a higher degree their physical and mechanical properties, such as regularity, resistance and extension.

Moreover, the process according to the invention and the apparatus according to the invention make it possible to reduce the requirements in terms of handling, and the space requirements of the apparatus are substantially reduced compared with the existing dyeing apparatus.

As a result, the overall cost of carrying out the process according to the invention is also reduced compared with the conventional known dyeing methods and the existing apparatuses.

It goes without saying that the invention is not limited to the embodiments described and shown in the accompanying drawings. Modifications, especially with respect to the design of the various elements or replacement by technical equivalents, are still possible without surpassing the scope of protection of the invention.

The examples below serve to explain the present invention.

EXAMPLE 1

An undyed bleached mercerized cotton yarn is unwound from a storage supply at a rate of 500 m/min and sprayed with a dyeing liquor by means of a nozzle, after which excess dye is removed pneumatically, and the yarn is then rewound onto a new support.

Composition of the dyeing liquor:
30 g/l of the dye of the formula:

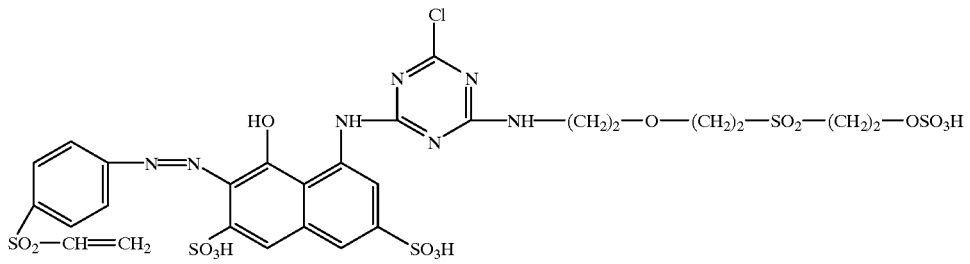

70 ml/l of sodium silicate 38° Bé
21 ml/l of sodium hydroxide solution 36° Bé
3 g/l of anionic wetting agent
3 g/l of penetration accelerator (aqueous solution containing ethoxylated linear $C_9$–$C_{11}$ fatty alcohols having terminal alkyl groups, castor oil/polyglycol ether, paraffin oil, bis(2-ethylhexyl) maleate, di(2-ethylhexyl) phosphate and sodium hydroxide as main components).

The rewound impregnated yarn is then stored at ambient temperature for 8 hours, which results in fixing of the dye on the fibre. Washing with hot water and subsequent drying give a yarn dyed in a brilliant red shade exhibiting good properties.

EXAMPLE 2

An undyed bleached mercerized cotton yarn is unwound from a storage supply at a rate of 500 m/min and sprayed with a dyeing liquor by means of a nozzle, and the yarn is then rewound onto a new support. Between the dye nozzle and the moving yarn, a perforated disc is arranged whose function is to allow spraying of the dyeing liquor onto the yarn only at previously defined and successive intervals.

Composition of the dyeing liquor:

30 g/l of the dye of the formula:

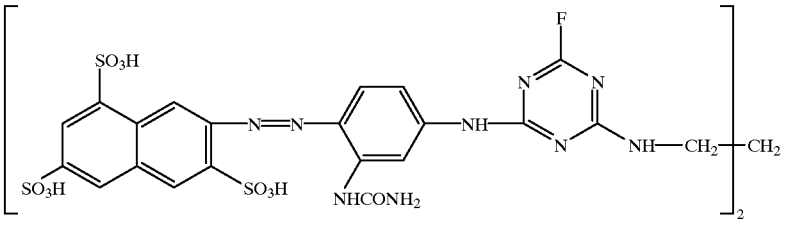

70 ml/l of sodium silicate 38° Bé
21 ml/l of sodium hydroxide solution 36° Bé
3 g/l of anionic wetting agent
3 g/l of penetration accelerator (aqueous solution containing ethoxylated linear $C_9$–$C_{11}$ fatty alcohols having terminal alkyl groups, castor oil/polyglycol ether, paraffin oil, bis(2-ethylhexyl) maleate, di(2-ethylhexyl) phosphate and sodium hydroxide as main components).

The rewound impregnated yarn is then stored at ambient temperature for 8 hours, which results in fixing of the dye on the fibre. The yarn is then washed at elevated temperature (about 60 to 80° C.) with an aqueous liquor containing 2 g/l of a detergent containing an acrylic acid copolymer and a nonionic surfactant and 1 g/l of a preparation of esterified phosphorus derivatives and water-soluble polymers, and the dyed yarn is dried. This gives a yarn of the chine type on which undyed portions and portions in a brilliant yellow shade alternate with one another.

EXAMPLE 3

An undyed bleached mercerized cotton yarn is unwound from a storage supply at a rate of 500 m/min and sprayed with three dyeing liquors by means of nozzles, and the yarn is then rewound onto a new support. Between each dye nozzle and the moving yarn, a perforated disc is arranged whose function is to allow spraying of the various dyeing liquors onto the yarn only at previously defined, synchronized and successive intervals, the synchronization and the angular speed of the perforated discs being correlated to the speed of the moving yarn.

Composition of the dyeing liquors:

Dyeing liquor 1:

30 g/l of the red dye of the formula from Example 1:
70 ml/l of sodium silicate 38° Bé
21 ml/l of sodium hydroxide solution 36° Bé
3 g/l of anionic wetting agent
3 g/l of penetration accelerator (aqueous solution containing ethoxylated linear $C_9$–$C_{11}$ fatty alcohols having terminal alkyl groups, castor oil/polyglycol ether, paraffin oil, bis(2-ethylhexyl) maleate, di(2-ethylhexyl) phosphate and sodium hydroxide as main components).

Dyeing liquor 2:

30 g/l of the dye of the formula:

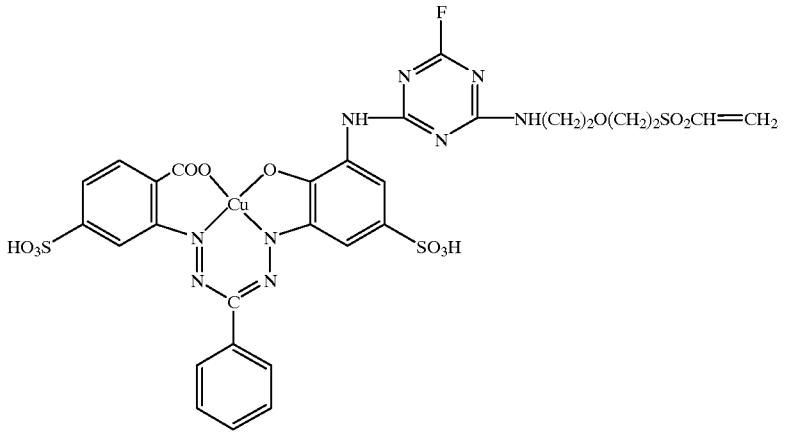

70 ml/l of sodium silicate 38° Bé
21 ml/l of sodium hydroxide solution 36° Bé
3 g/l of anionic wetting agent
3 g/l of penetration accelerator (aqueous solution containing ethoxylated linear $C_9$–$C_{11}$ fatty alcohols having terminal alkyl groups, castor oil/polyglycol ether, paraffin oil, bis(2-ethylhexyl) maleate, di(2-ethylhexyl) phosphate and sodium hydroxide as main components).

Dyeing liquor 3:
70 g/l of the dye of the formula:

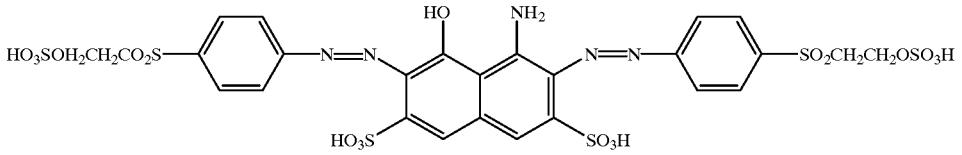

70 ml/l of sodium silicate 38° Bé
34 ml/l of sodium hydroxide solution 36° Bé
3 g/l of anionic wetting agent
3 g/l of penetration accelerator (aqueous solution containing ethoxylated linear $C_9$–$C_{11}$ fatty alcohols having terminal alkyl groups, castor oil/polyglycol ether, paraffin oil, bis(2-ethylhexyl) maleate, di(2-ethylhexyl) phosphate and sodium hydroxide as main components).

The rewound impregnated yarn is then stored at ambient temperature for 6 to 8 hours, which results in fixing of the dye on the fibre. The yarn is then washed at elevated temperature (about 60 to 80° C.) with an aqueous liquor containing 2 g/l of a detergent containing an acrylic acid copolymer and a nonionic surfactant and 1 g/l of a preparation of esterified phosphorus derivatives and water-soluble polymers, and the dyed yarn is dried. This gives a multicolour yarn in which portions dyed in red, blue and black and also portions with different shades of the mixture of the three dyes used alternate with another.

EXAMPLE 4

An undyed unbleached unwashed cotton yarn is unwound from a storage supply at a rate of 500 m/min and sprayed with a dyeing liquor by means of a nozzle, and the yarn is then rewound onto a new support. Between the dye nozzle and the moving yarn, a perforated disc is arranged whose function is to allow spraying of the dyeing liquor onto the yarn only at previously defined and successive intervals.

Composition of the dyeing liquor:
0.5 g/l of the red dye of the formula from Example 1
11 g/l of the blue formazan dye of the formula from Example 3
70 m/l of sodium silicate 38° Bé
15 ml/l of sodium hydroxide solution 36° Bé
3 g/l of anionic wetting agent
3 g/l of penetration accelerator (aqueous solution containing ethoxylated linear $C_9$–$C_{11}$ fatty alcohols having terminal alkyl groups, castor oil/polyglycol ether, paraffin oil, bis(2-ethylhexyl) maleate, di(2-ethylhexyl) phosphate and sodium hydroxide as main components).

The rewound impregnated yarn is then stored at ambient temperature for 6 to 8 hours, which results in fixing of the dye on the fibre. The yarn is then washed at elevated temperature (about 60 to 80° C.) with an aqueous liquor containing 2 g/l of a detergent containing an acrylic acid copolymer and a nonionic surfactant and 1 g/l of a preparation of esterified phosphorus derivatives and water-soluble polymers, and the dyed yarn is dried. This gives a blue yarn with special effects, which is suitable for use in weaving fabrics for blue jeans of the denim type as dyed by the indigo method. Depending on the pressure supplied to the impregnating nozzles, which results in different loadings (depending on the throughput of the nozzles and the rate at which the dyeing liquor leaves the bath) on the yarn (% impregnation), different ring-dyeing levels can be obtained, which gives the impression that the yarns have been stone washed to a different degree.

What is claimed is:

1. An apparatus for the continuous dyeing of yarns moving along a path having an axis of movement, said yarns being based on cellulose fibers, the apparatus comprising:

an unwinding device for the continuous high-speed unwinding of yarn from one or several supports;

an impregnation apparatus for impregnating unwound yarn(s) with one or several dyes which are employed individually or in a mixture in the form of one or more dyeing liquors;

a first rewinding device for rewinding treated yarn(s) onto one or more other supports;

a storage unit for fixing the dyes;

an intermediate rack for unwinding the yarn(s) leaving the storage unit;

a washing and draining unit;

a drying apparatus; and a second rewinding device for rewinding the yarn(s) onto new supports.

2. The apparatus according to claim 1, wherein the impregnation apparatus comprises a dyeing machine equipped with multiple applicators each assigned to a different dyeing liquor and each delivering in succession, in sequences of identical or unequal lengths, spots of different dyes.

3. The apparatus according to claim 1, wherein the washing and draining unit has an analogous construction to that of the impregnation apparatus, where bath troughs and atomizing and spraying nozzles are simply fed with water, or water containing detergent products, and the draining operation is carried out by squeezing-off means which remove the water from the yarn.

4. The apparatus according to claim 1, wherein the drying apparatus is in the form of a tunnel through which the yarn(s) pass and which is supplied with hot air or a hot gas under pressure.

5. The apparatus according to claim 1, wherein the drying apparatus is in the form of a chamber for concentrating the yarn through formation of successive loops on tensioning rollers, said chamber being subjected to circulating hot air or hot gas.

6. The apparatus according to claim 1, wherein the drying apparatus is in the form of a tunnel through which the yarn(s) pass and which is supplied with high-frequency or infrared energy.

7. The apparatus according to claim 1, wherein the drying apparatus is either in the form of a means for blowing in hot air during winding or in the form of a high-frequency infrared drying tunnel for bobbins.

8. The apparatus according to claim 1, wherein the impregnation apparatus comprises nozzles which are each arranged at right angles to the axis of movement of one or several yarns, the dyeing liquor being sprayed in succession by said nozzles through the slot provided in a disk which extends between said nozzles and the path of the yarn, said disk being mounted for rotation around a vertical axis.

9. The apparatus according to claim 1, wherein the impregnation apparatus comprises a rotating turbine using a plate, said rotating turbine being in the form of a hollow cylindrical body equipped on its periphery with a plurality of dye-spraying nozzles of identical or different cross sections; said turbine being mounted for rotation about an axis extending parallel to the axis of movement of the yarns, and the dyeing liquor being sprayed through said nozzles.

10. The apparatus according to claim 1, wherein the impregnation apparatus comprises a dyeing liquor trough which is maintained at a constant level by a feed pump which is linked to a storage tank containing the dyeing liquor which is heated by a heat source, the yarn(s) to be impregnated being diverted into the dyeing liquor by return idlers, and squeezing-off means for squeezing off excess dye on the yarn(s) with compressed air whose pressure can be regulated, the entire impregnation apparatus being arranged in a chamber for recovering squeezed-off dye, and provided with openings through which the yarn(s) can pass.

11. The apparatus according to claim 10, wherein the squeezing-off means comprise a vessel which is provided with two openings through which the yarn(s) charged with dyeing liquor pass and which is subjected to superatmospheric pressure.

12. The apparatus according to claim 1, wherein the impregnation apparatus comprises a dye storage tank (26) connected by a feed line and a pump to a pressurized impregnation channel formed, for each yarn or for a plurality of yarns, by a longitudinal tube through which the yarn(s) pass in its longitudinal direction, a squeeze-off unit for squeezing off excess dyeing liquor being arranged downstream from said channel, the dyeing liquor discharged from said pressurized impregnation channel and that coming from the squeeze-off unit being recovered at the bottom of the chamber forming the impregnation apparatus and returned to the dye storage tank via a recycle conduit.

13. The apparatus according to claim 12, wherein the pressurized impregnation channel is designed in tubular form, which is particularly suitable for dyeing unitary yarns, or in the form of a rectangular elongated box for dyeing multiple yarns in sheet or strand form, the cross section and the length of each channel being selected in such a manner that the time of contact of the yarn with the dyeing liquor is variable as a function of the yarn speed, and the relative speed of the dyeing liquor which circulates in the channel is variable with respect to the yarn speed in that same channel.

14. The apparatus according to claim 12, wherein the pressurized dyeing liquor is made to reach the channel at intervals.

15. The apparatus according to claim 12, wherein each pressurized impregnation channel is provided, on its inside surface which extends parallel to the direction of movement of the yarn, with rough sections or obstacles or surface deformations.

16. The apparatus according to claim 1, wherein the impregnation apparatus is in the form of an impregnating pad-mangle comprising two horizontal cylinders which along their surface line are in contact with one another and above which dyeing liquor is maintained constantly by provision of lateral leakproof cheek plates at the cylinder ends, the yarn(s) being impregnated by passage between said cylinders.

17. The apparatus according to claim 1, wherein the impregnation apparatus is in the form of a contact impregnation drum which dips in a dyeing liquor and applies said dyeing liquor by contact with the moving yarn(s) which are guided by return idlers over a portion of the circumference of the drum, the position of said return idlers being adjustable with respect to the drum.

18. The apparatus according to claim 1, wherein the impregnation apparatus is divided into a plurality of yarn impregnation chambers.

* * * * *